US009617021B2

(12) United States Patent
McCorkle et al.

(10) Patent No.: US 9,617,021 B2
(45) Date of Patent: Apr. 11, 2017

(54) APPARATUS FOR BAGGING A BALE AND METHOD OF BAGGING SUCH BALE

(71) Applicant: LANGSTON COMPANIES, INC., Memphis, TN (US)

(72) Inventors: Timothy J. McCorkle, Bakersfield, CA (US); Anton G. Holty, Bakersfield, CA (US); Edward D. Mayer, Bakersfield, CA (US)

(73) Assignee: LANGSTON COMPANIES, INC., Memphis, TN (US)

( * ) Notice: Subject to any disclaimer, the term of this patent is extended or adjusted under 35 U.S.C. 154(b) by 972 days.

(21) Appl. No.: 13/835,857

(22) Filed: Mar. 15, 2013

(65) Prior Publication Data

US 2013/0291485 A1 Nov. 7, 2013

Related U.S. Application Data

(60) Provisional application No. 61/614,901, filed on Mar. 23, 2012.

(51) Int. Cl.

| | |
|---|---|
| ***B65B 39/00*** | (2006.01) |
| ***B65B 5/04*** | (2006.01) |
| ***B65B 25/02*** | (2006.01) |
| ***B65B 35/20*** | (2006.01) |
| ***B65B 39/02*** | (2006.01) |
| ***B65B 39/06*** | (2006.01) |
| ***B65B 43/46*** | (2006.01) |
| ***B65B 7/08*** | (2006.01) |

(52) U.S. Cl.

CPC ..... *B65B 5/045* (2013.01); *B65B 7/08* (2013.01); *B65B 25/02* (2013.01); *B65B 35/20* (2013.01); *B65B 39/007* (2013.01); *B65B 39/02* (2013.01); *B65B 39/06* (2013.01); *B65B 43/465* (2013.01)

(58) Field of Classification Search

CPC ..... B65B 5/045; B65B 39/02; B65B 39/06; B65B 39/007; B65B 43/265; B65B 43/465

USPC ..... 53/381.1, 384.1; 198/817, 786

See application file for complete search history.

(56) References Cited

U.S. PATENT DOCUMENTS

| | | | |
|---|---|---|---|
| 2,751,134 | A | 6/1956 | Walldow |
| 3,206,913 | A | 9/1965 | Fleigher et al. |
| 3,228,173 | A | 1/1966 | Reynolds |

(Continued)

FOREIGN PATENT DOCUMENTS

| | | | |
|---|---|---|---|
| EP | 0 340 380 | B1 | 5/1992 |

OTHER PUBLICATIONS

International Search Report for corresponding PCT Application No. PCT/IB2013/000993 dated Feb. 7, 2014.

*Primary Examiner* — Andrew M Tecco
*Assistant Examiner* — Chelsea Stinson
(74) *Attorney, Agent, or Firm* — Workman Nydegger

(57) ABSTRACT

A bale bagging apparatus for wrapping a bag around a bale of compressed material includes a base frame member having a first end and a second end, a transportation system, a bale chute and a bag retrieval system. The transportation system is provided to transport a bale through the bale chute having a bag for wrapping the bale. Additionally, the bale bagging apparatus has the bag retrieval system to position a bag from a first position to a second position to a third position, where in the third position an open end of the bag is positioned around the output end of the bale chute when the bale is transported by the transportation system through the bale chute.

18 Claims, 20 Drawing Sheets

(56) References Cited

U.S. PATENT DOCUMENTS 3,287,882 A 11/1966 Smith
3,490,195 A 1/1970 Abramson
3,508,379 A 4/1970 Noyes et al.
3,538,671 A 11/1970 Wallace
3,540,179 A 11/1970 Watts, Jr.
3,584,435 A * 6/1971 Grasvoll ..... B65B 9/06 53/557
3,628,720 A 12/1971 Schmedding
3,868,807 A 3/1975 Noyes et al.
3,948,015 A 4/1976 Lerner
4,047,362 A * 9/1977 Lister ..... B65B 5/067 53/258
4,241,562 A 12/1980 Meyer
4,300,327 A * 11/1981 Bridger ..... B65B 5/045 53/255
4,370,845 A 2/1983 Perolls et al.
4,385,722 A 5/1983 Brewill
4,586,318 A 5/1986 Litt et al.
4,590,747 A 5/1986 Schjeldahl
4,730,437 A 3/1988 Benno
4,805,381 A 2/1989 Hannon
4,912,911 A * 4/1990 Down ..... B65B 11/04 53/211
5,099,736 A 3/1992 Evers
5,226,735 A 7/1993 Beliveau
5,442,898 A 8/1995 Gabree et al.
5,551,215 A 9/1996 McDonald et al.
6,045,838 A 4/2000 Davis et al.
6,131,733 A 10/2000 Ergle et al.
6,234,303 B1 * 5/2001 Gales ..... B65G 1/0492 198/817
6,318,894 B1 11/2001 Derenthal
6,394,727 B1 5/2002 Lundberg
6,457,863 B1 10/2002 Vassallo
6,659,644 B2 12/2003 Gebhardt
6,672,038 B2 1/2004 McGrane et al.
6,895,726 B2 5/2005 Pinto et al.
7,013,625 B2 3/2006 Curles
7,048,109 B2 * 5/2006 Brixius ..... B65G 17/002 198/465.3
7,134,256 B2 11/2006 Kujubu et al.
7,448,185 B2 11/2008 Zeedyk et al.
7,472,788 B2 * 1/2009 Bonora ..... B65G 15/12 198/817
7,497,622 B2 3/2009 Kozak
7,665,278 B2 2/2010 Griggs et al.
7,793,773 B2 * 9/2010 Beck ..... B65G 39/125 198/571
7,861,500 B2 1/2011 Bennett
7,987,651 B2 * 8/2011 Beeland ..... B65B 27/125 493/156
8,033,383 B2 * 10/2011 Horn ..... B65G 13/06 198/606
8,376,130 B2 * 2/2013 Deyanov ..... B65G 15/105 198/817
8,746,087 B2 * 6/2014 Actis ..... B65B 43/267 73/863.91
2002/0112452 A1 8/2002 DeSmedt
2002/0134702 A1 9/2002 DeSmedt et al.
2002/0170274 A1 11/2002 Huseman
2003/0230052 A1 12/2003 Rabiea
2004/0035087 A1 * 2/2004 Kujubu ..... B65B 25/064 53/257
2004/0216431 A1 * 11/2004 Curles ..... B65B 43/30 53/570
2005/0022467 A1 * 2/2005 Kujubu ..... B65B 5/045 53/67
2005/0047685 A1 3/2005 Tsutsumi
2005/0229547 A1 * 10/2005 Koke ..... B65B 25/065 53/468
2008/0050208 A1 * 2/2008 Kitazumi ..... B65G 15/10 414/173
2009/0188332 A1 7/2009 Actis
2009/0241474 A1 * 10/2009 Actis ..... B65B 5/045 53/456
2009/0241487 A1 10/2009 Actis
2010/0126118 A1 5/2010 Actis
2011/0094396 A1 * 4/2011 Borrelli ..... A01F 15/04 100/45
2011/0209439 A1 9/2011 Actis

* cited by examiner

APPARATUS FOR BAGGING A BALE AND METHOD OF BAGGING SUCH BALE

CROSS REFERENCE

This application claims the benefit of U.S. provisional application Ser. No. 61/614,901, filed Mar. 23, 2012, the entirety of which is herein incorporated by reference.

FIELD

The present disclosure relates to an apparatus for bagging a bale and method of bagging such bale.

SUMMARY

The present disclosure describes an embodiment of an invention directed to a bagging apparatus for bales of compressed material, such as cotton, having a base frame parallel to a longitudinal feed direction, a conveyor system coupled to the base frame, a bale feeding station at one end of the base frame member, a bale chute coupled to the base frame downstream of the bale feeding station along the longitudinal feed direction, a bagging station coupled to the base frame member between the first and second ends after the bale chute, a gantry having a gantry beam coupled to top sections of vertical supports parallel the longitudinal feed direction between the first and second ends of the base frame member, a bale pusher having a driving mechanism coupled to the base frame arranged to move in the longitudinal feed direction, and a sealing module located at the second end of the base frame member and a method for bagging thereof.

The resulting bale bagging apparatus has a simple construction for easy installation that allows the efficient and easy placement of a bag around the bag chute for bagging a bale.

In accordance with the structure of the described embodiment, the bagging station is located downstream of the bale chute along the longitudinal feed direction between the first and second ends of the base frame member. The bagging station has a gantry and the second section and gap section of the conveyor system, where the at least one gap section is provided between second and third sections of the conveyor system in the bagging station. The gantry has at least two vertical supports having top sections, a gantry beam having ends coupled to the top sections of the two vertical supports, a track coupled to the gantry beam, and a retrieval device movably coupled to the gantry beam. The vertical supports are positioned transversely from the base frame member so that the gantry and retrieval assembly is positionable along the longitudinal feed direction and second gap section.

The retrieval assembly is configured to pick-up an open end of the bag from a pallet of bags so that a closed end of the bag hangs downwardly. The retrieval device can then move from a first position to a second position, where the second position is a position where the closed end of the bag is aligned perpendicularly to the longitudinal feed direction to the at least one gap section. After which, the retrieval device moves in a direction transverse to the longitudinal feed direction so that the closed end of the bag is positioned in the at least one gap section. The open end of the bag can then be moved in the longitudinal direction forwardly towards the bag chute to position the open end of the bag around the bale chute.

This inventive structure allows the straightening of the bag for placement of the bag around the bale chute in a compact, efficient arrangement. By straightening the length of the bag, the bag is better positioned to receive the bale fed into the bale chute using a simple and easy to install structure.

Additionally, the second section of the conveyor system can comprise rollers inclined outwardly and upwardly from a center position of the second section. By inclining the rollers, the bagged bale fed from the bale chute only contacts the rollers of the second section of the conveyor system along corners of the bale. Since the corners of the bale are mostly cotton and the bottom surface of the bale does not directly contact the rollers, damage to the bag from the bailing wire or other hard surfaces is mitigated. Additionally, there is lower frictional resistance for bagging the bale.

The numerous advantages, features and functions of the various embodiments of the invention described herein will become readily apparent and better understood in view of the following description and accompanying drawings. The following description is not intended to limit the scope of the apparatus for bagging a cotton bale, but instead merely provides exemplary embodiments for ease of understanding.

BRIEF DESCRIPTION OF THE DRAWINGS

Examples of an cotton bale bagging apparatus according to different embodiments of the invention will now be explained in more detail with reference to the drawings, wherein.

Figure 1:
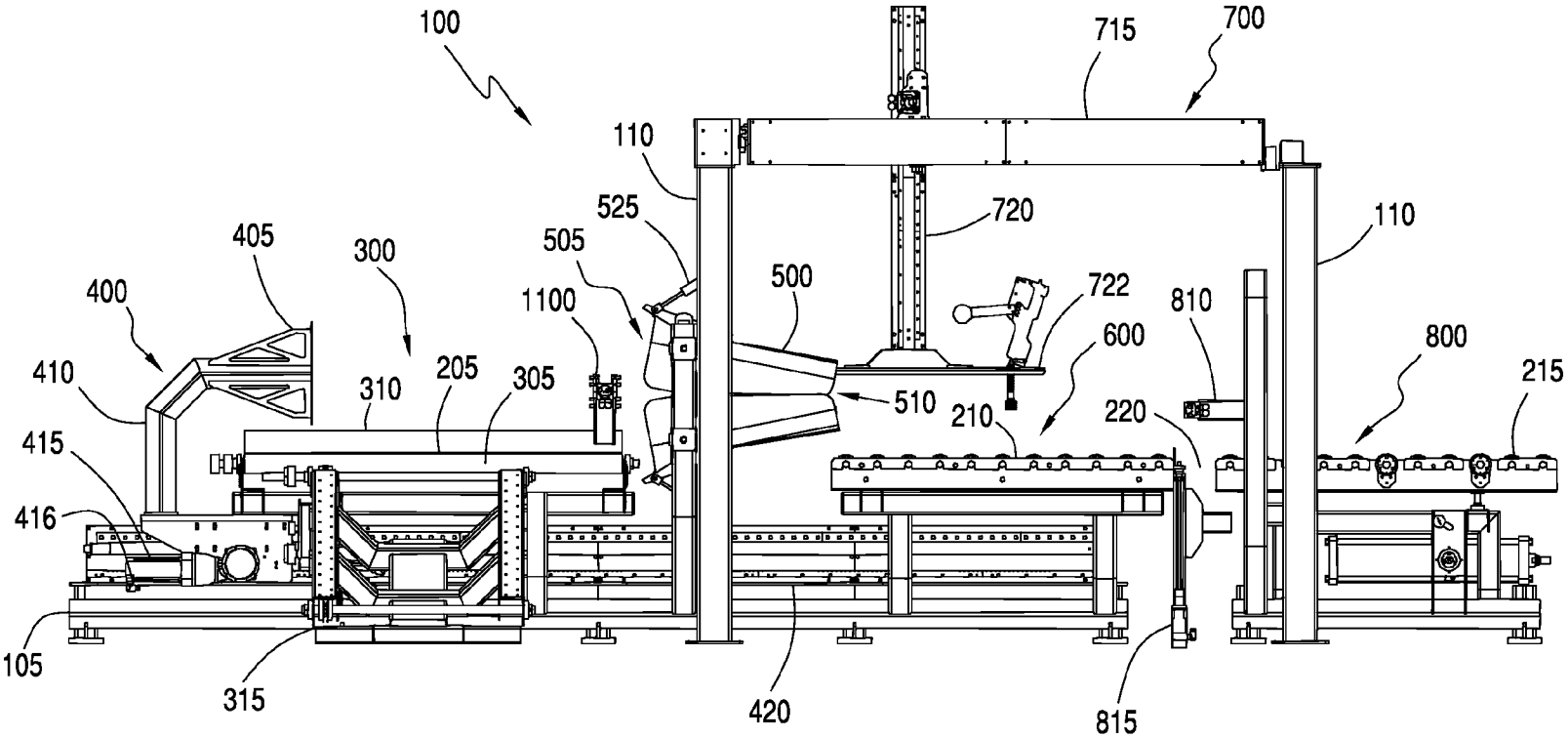
FIG. 1 is a right side view of a bale bagging apparatus showing a bale feeding station, a bale pusher, a bale chute, a gantry, a bale bagging station, a sealing module, and a conveyor system for transporting a bale along the bale bagging apparatus along a longitudinal feed direction.

In the various figures, similar elements are provided with similar reference numbers. It should be noted that the drawing figures are not necessarily drawn to any scale, or proportion, but instead are drawn to provide an understanding of the method according to the invention and the resulting piston form and components. Thus, the illustrations are not intended to be limiting as to the scope of the invention described herein, but rather to provide exemplary illustrations thereof.

DETAILED DESCRIPTION OF ILLUSTRATIVE EMBODIMENTS OF THE INVENTION

A. Discussion of Various Embodiments

As generally discussed above, prior art bale bagging machines have complicated designs involving multiple moving mechanical parts and complex structures that require careful maintenance and that are prone to malfunction. To overcome this shortcoming, the embodiments in the present disclosure were developed to create an easy to install cotton bale bagging machine that is simpler to manufacture efficiently and commercially practical.

For example, as seen in FIG. 1, one embodiment of the cotton bale bagging machine 100 includes a bale feeding station 300 on a first end of the cotton bale bagging machine 100, a sealing module 800 on a second end of the cotton bale bagging machine 100, a bale chute 500, a gantry 700, and a bale bagging station 600 between the first and second ends of the bale bagging machine 100, and a conveyor system 200 that is coupled to the bale feeding station 300, sealing module 800, and bale bagging station 600 in a way such that the conveyor system 200 is used to transfer a bale, e.g., cotton bale, in a longitudinal and linear feed direction from the bale feeding station 300 to the sealing module 800.

The cotton bale bagging machine 100 also has a base and a bottom frame member 105 at the base of the bale bagging machine 100 that runs substantially linearly in the longitudinal direction to support the bale feeding station 300, the bale chute 500, the sealing module 800 and the conveyor system 200. One end of the bottom frame member 105 is positioned near the bale feeding station 300, while the second end is positioned near either the sealing module 800 or near the bale bagging station 600. When the second end of the bottom frame member 105 is positioned near the bale bagging station 600, the bottom frame member 105 further comprises a second section for supporting the sealing module 800.

The bottom frame member 105 has a solid or hollow beam and/or at least two linear bars or beams to create a frame that has the linear bars or beams positioned in parallel to the longitudinal feed direction and connected transversely by feet for supporting the base. The bottom frame member 105 is made from steel, ferrous alloys, composite materials, or other material that can be used to support the stations and bale during the bale bagging operation.

Additionally, the bale bagging machine 100 has at least two vertical supports 110 for supporting the gantry 700 between the first and second ends of the bale bagging machine 100. Preferably, four vertical supports 110 are used for supporting the gantry 700, so that the gantry 700 is movable in longitudinal, transverse, and vertical directions with respect to the longitudinal feed direction. The four vertical supports 110 are positioned transversely on outer sides of the bottom base frame 105, where one end of each of the supports 110 is located near the base of the bale bagging machine 100 and the second end of the support 110 is located above the conveyor system 200.

This efficient design for a bale bagging machine 100 uses a conveyor system 200 comprising at least a first section 205, a second section 210, a third section 215, and a gap section 220. The first section 205 of the conveyor system 200 is located at the first end of the bale bagging machine 100 near the bale feeding station 300, while the second section 210 is located at the bale bagging station 600 after the bale chute 500, and the third section 215 is located near the sealing module 800 at the second end of the bale bagging machine 100. The gap section 220 is located between the second section 210 and the third section 215 and has a gap distance greater than the thickness of a bag used for bagging the bale, e.g., a gap distance greater than at least 6 inches.

The conveyor system 200 uses conventional conveyors known in the art. For example, rollers are used which are rotatably coupled to a frame or tray. The rotating rollers can then be used as a guiding mechanism to help move the bale in the desired directions by having the rollers rotate in the transverse and longitudinal directions. The rotating rollers can be made from Teflon, plastic, metal, or other material that facilitates the movement of the bale along the bale bagging machine 100. Additionally, the conveyor system 200 can also use belts, chains, and/or other driving mechanisms to move the bale in the longitudinal and transverse directions.

The embodiment of the bale bagging machine 100 as seen in FIGS. 1-5 will be described in greater detail below.

As further seen in FIGS. 1-4, the bale feeding station 300 includes a bale receiver 305, a staging device 310 located at the first end of the bale bagging machine 100, and the first section 205 of the conveyor system 200. The bale feeding station 300 is coupled to the first end of the bottom frame member 105 along vertical beams coupled to the bottom frame member 105.

The bale receiver 305 is an opening along the first section 205 that is used to receive a bale from a bale feeder 315 connected to the first end of the bottom frame member 105. The bale feeder 315 uses an inclined drag chain conveyor, guided or non-guided motorized or actuated transfer cart, carriages, slides, or other device to move the bale from a floor or input bale feed to the bale receiver 305. The bale feeder 315 may be coupled to the bale feeding station 300 or to the bottom frame member 105 to allow the feeding of the bale in a transverse direction with respect to the longitudinal feed direction or in the same direction as the longitudinal feed direction.

The first section 205 uses transverse rotating rollers 206 coupled to a frame using pins or other fastening devices to allow the rollers to rotate in a transverse direction with respect to the longitudinal feed direction. By having the transverse rotating rollers 206 rotate in the transverse direction, the bale fed through the bale receiver 305 can continue to move transversely onto the first section 205 of the conveyor system 200 for the simple staging of the bale.

Figure 2:
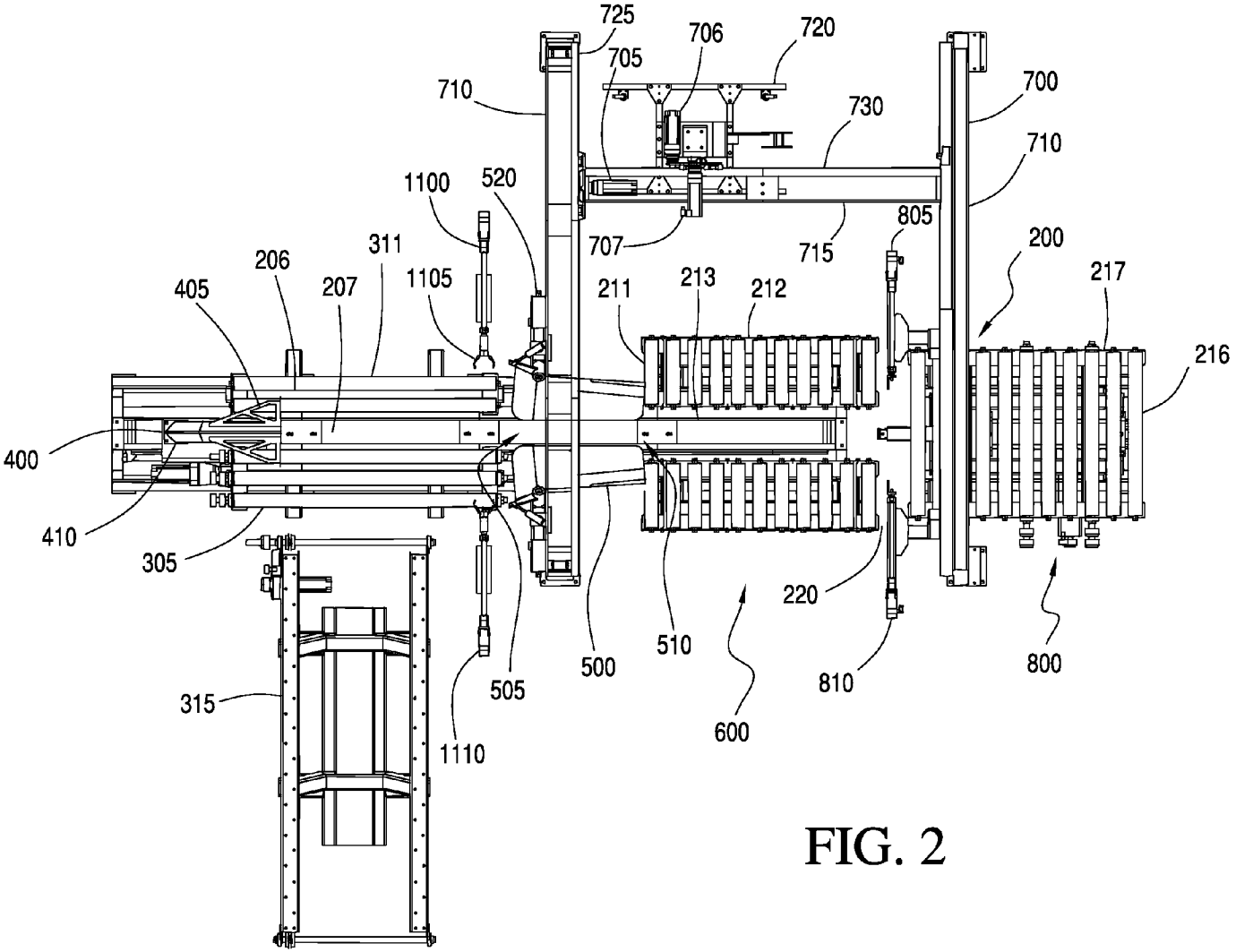
FIG. 2 is a top side view of the bale bagging apparatus showing the tops of each section of the bale bagging apparatus.

FIG. 2 shows that a first gap 207 can be provided between two or more transverse rotating rollers 206 of the first section 205. The first gap 207 has a gap width that allows a bale pusher 400 to move in the longitudinal feed direction between the at least two transverse rotating rollers 206, as discussed below in detail. The transverse rotating rollers 206 of the first section 205 can be driven to rotate in the transverse direction using a roller drive (not shown) or can freely rotate.

The staging device 310 of the bale feeding station 300 is a side bumper 311 located on the opposite side of the bale receiver 305 across the first section 205 of the conveyor system 200 to stage the bale being fed from the bale feeding device 315. For example, the side bumper 311 runs linearly in the longitudinal feed direction, i.e., has one end near the first end of the bale bagging machine 100 and has another end closer to the bale bagging station 600. By having the side bumper 311 located on the opposite side of the bale receiver 305, the side bumper 311 is arranged to stop the bale fed onto the transverse rotating rollers 206 to easily and simply stage the bale in an appropriate position for the longitudinal feeding of the bale along the bale bagging machine 100.

The staging device 310 can also include a switch or a photoeye or light curtain (not shown) to detect the presence of the bale at the appropriate location. When the bale is detected by the switch or photoeye or light curtain in the appropriate position, the switch or photoeye or light curtain can be used to control the movement of the roller drive of the first section 206.

As seen in FIG. 1, the bale pusher 400 has a start position near the bale feeding station 300. The bale pusher 400 has a pushing section 405, a pushing section carriage 410, and a driving mechanism 415 for moving the bale pusher 400 from the bale feeding section 305 to the second section 210 of the conveyor system 200 and back to the bale feeding section 305. The pushing section carriage 410 couples the pushing section 405 to the driving mechanism 415 to allow the pushing of the bale in the longitudinal feed direction.

The pushing section 405 of the bale pusher 400 has a planar face that runs transversely to the longitudinal feed direction. The planar face has a surface contact area that allows the distribution of force on the pushed bale, so that the pushed bale is not damaged. The pushing section 405 and pushing section carriage 410 are made from steel, metal alloys, composites, and other material that is designed for moving loads.

The driving mechanism 415 moves the bale pusher 400 along a linear drive track 420 coupled to the bottom frame member 105 linearly in the longitudinal feed direction. The driving mechanism 415 can be driven by a servo gear motor 416 that drives a rack (not shown), i.e., a gear, along a pinion (not shown) on the linear drive track 420. The skilled person would appreciate that other drive mechanisms could be used to move the driving mechanism 415 along the linear drive track 420, such as, chains, pulleys, or similar devices.

The bale chute 500 is positioned after the first section 205 but before the bale bagging station 600. The bale chute 500 has an input end 505 near the bale feeding station 300 and an output end 510 near the bale bagging station 600 for receiving and discharging the bale moved longitudinally along the bale bagging machine 100. The bale chute 500 comprises at least two pivoting sections, but preferably, has at least four pivoting sections 515, 516, 517, 518, mounted on a chute frame 520 attached to the bottom frame member 105.

Figure 5:
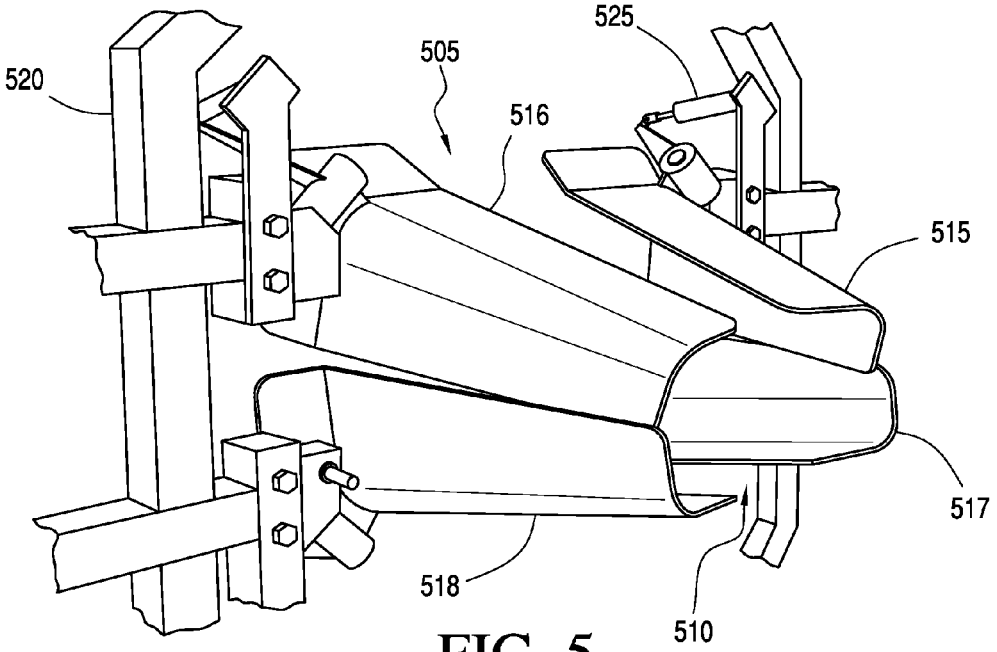
FIG. 5 is a right side isometric view of the bale chute illustrated in FIGS. 1-3 showing a closed position of at least four pivotable sections.
Figure 6:
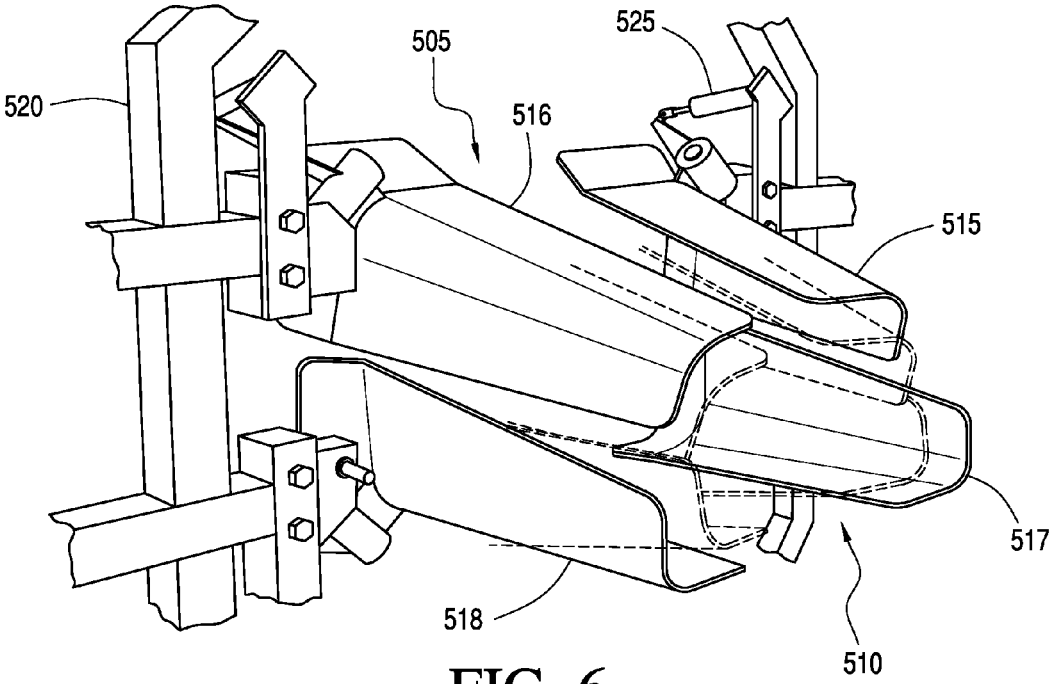
FIG. 6 is a right side isometric view of the bale chute illustrated in FIGS. 1-3 showing an intermediary open position of the at least four pivotable sections.
Figure 7:
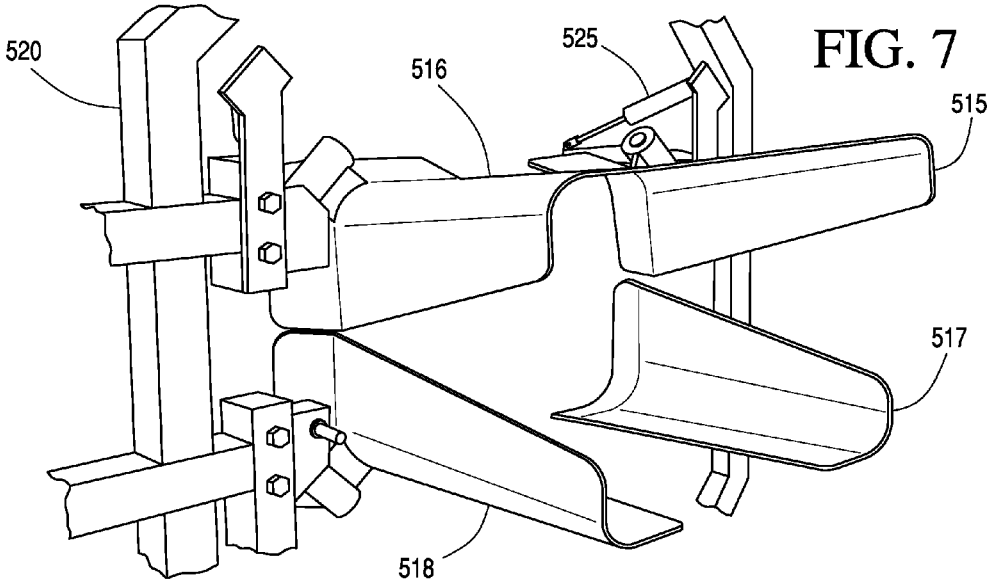
FIG. 7 is a right side isometric view of the bale chute illustrated in FIGS. 1-3 showing an open position of the at least four pivotable sections.

As seen in FIGS. 5-7, the at least four pivoting sections 515, 516, 517, 518 are pivotally connected to the chute frame 520 using actuators 525, e.g., double acting pneumatic cylinders, to move between at least a closed position and an open position. The positioning of the actuators 525 are controlled using a controller (not shown).

FIG. 5 shows the at least four pivoting sections 515, 516, 517, 518 pivoted in the closed position, where the actuators 525 pivot the pivoting sections 515, 516, 517, 518 towards each other to a center position of the bale chute 500, i.e., the pivoting sections are pivoted towards the other pivoting sections. As seen in FIG. 7, the at least four pivoting sections 515, 516, 517, 518 can also be pivoted from the closed position to the open position, where the four pivoting sections 515, 516, 517, 518 are driven outwardly away from the center position of the bale chute 500, i.e., the pivoting sections are pivoted away from the other pivoting sections.

FIG. 6 illustrates an intermediary open position that can also be used where the at least four pivoting sections 515, 516, 517, 518 are not fully opened. In this intermediary position, the at least four pivoting sections 515, 516, 517, 518 are pivoted outwardly away from the central position of the bale chute 500 to a position where outer sides of the pivoting sections are substantially parallel to each other. From this position, at least the top pivoting sections 515, 516 are pivoted further away from the center of the bale chute 500, i.e., a more open position as seen in FIG. 7. In this more open position, the outer sides of the pivoting sections 515, 516 are no longer parallel with the remaining pivoting sections.

Referring back to FIGS. 1-4, the bagging station 600 is located after the bale feeding station 300 and the bale chute 500. The bagging station 600 includes the second section 210 and the gap section 220 of the conveyor system 200 and the gantry 700. The design of the bagging station 600 provides an easy to assemble and uniquely designed machine for the placing of the bag for bagging the bale that utilizes the gap section 220 and/or inclined rollers for the positioning and the feeding of the bale in the bag.

The second section 210 has at least two roller frames 212 coupled to and supported by vertical beams connected to the bottom frame member 105 and at least two sets of longitudinally rotating rollers 211 rotatably coupled to the roller frames 212. A second gap 213 is located at a center position 214 between the at least two roller frames 212 that has a width to allow the movement of the bale pusher 400 between the two roller frames in the longitudinal feed direction.

Figure 8:
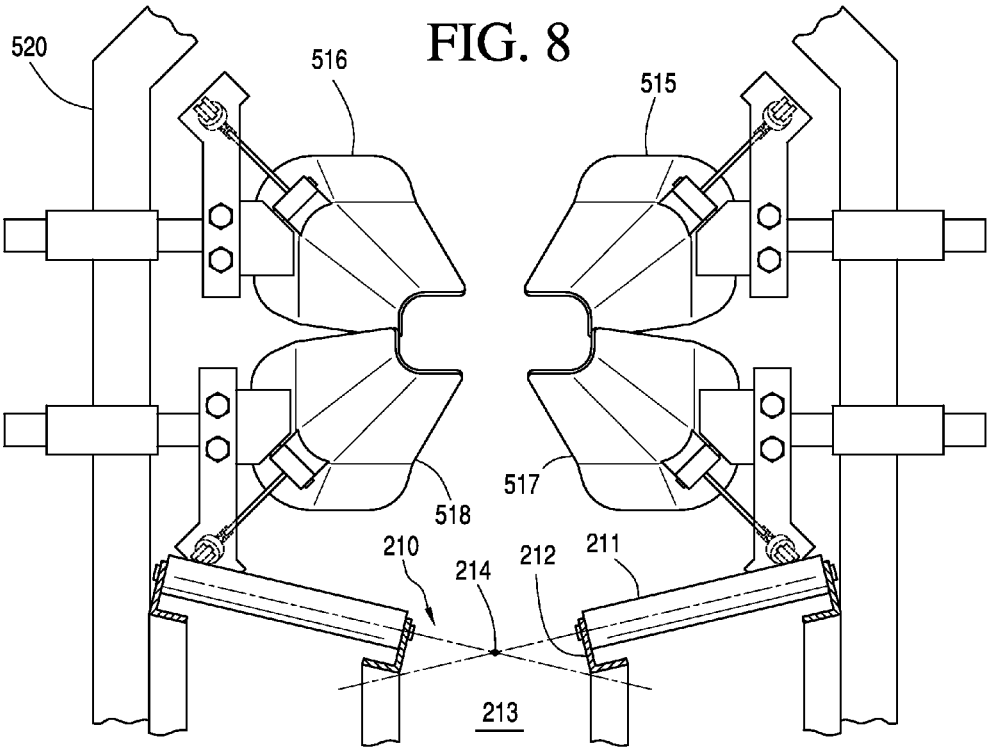
FIG. 8 is a longitudinal back view of a bagging station and bale chute of a second embodiment of a bale bagging apparatus having a inclined rollers.
Figure 9:
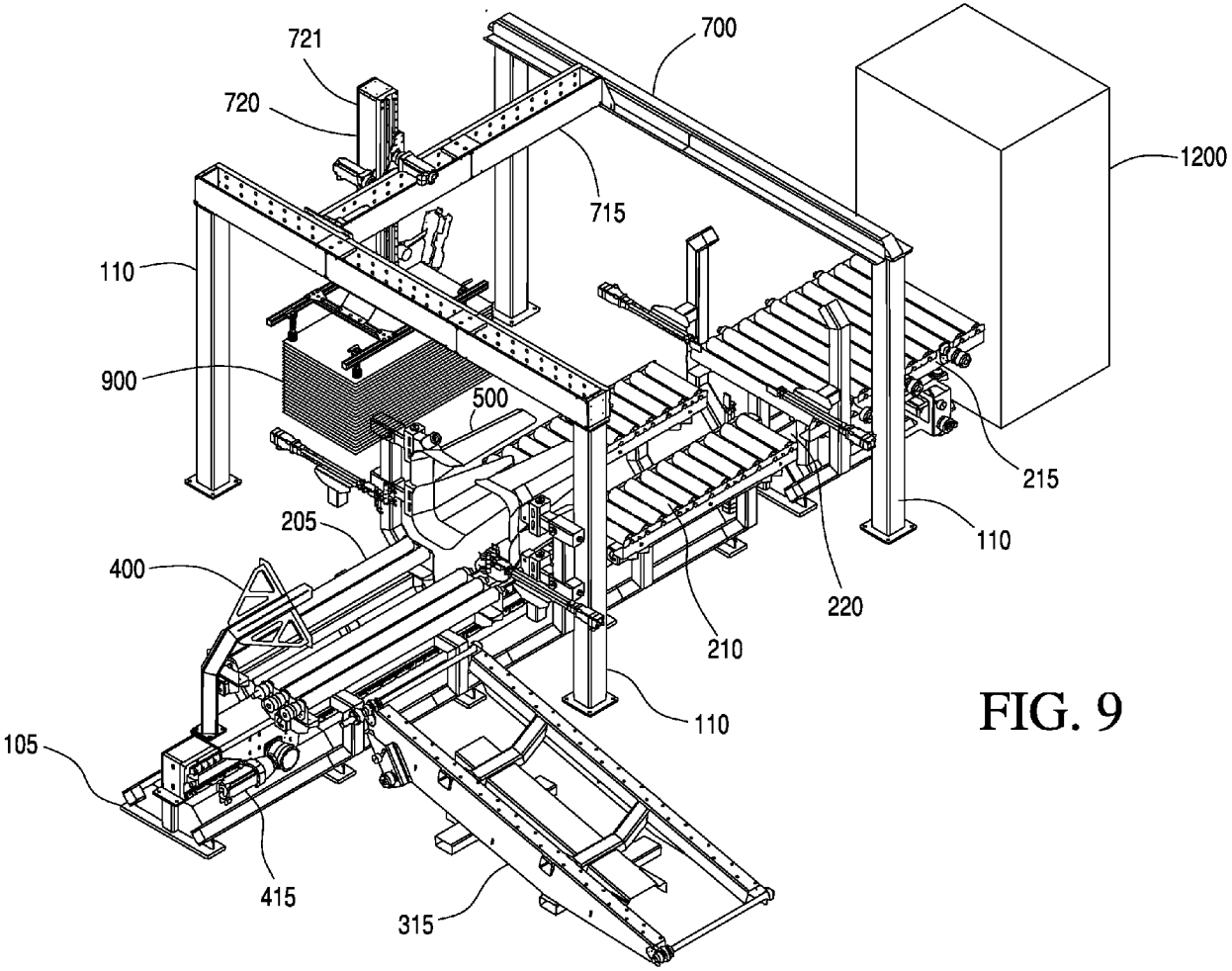
FIG. 9 is a right side isometric view of a bale bagging apparatus showing an embodiment of a method for placing a bag around pivoting sections of an output end of the bale chute by picking up a bag from a bag pallet.

The two sets of longitudinally rotating rollers 211 can be substantially horizontal with respect to the base of the bale bagging machine 100. Alternatively, as seen in FIG. 8, the rotating rollers 211 can be inclined where one end of the longitudinally rotating rollers 211 is located near the center position 214 of the second section 210 and the other end is located at an outward position above the one end, i.e., the longitudinally rotating rollers 211 have an incline angle greater than 5° from an imaginary horizontal plane (dotted lines) at the center position 214 of the second section 210 to an outer position of each set of roller frames 212.

FIGS. 1-4 show that the gantry 700 is coupled to top sections of the at least four vertical supports 110 of the bale bagging machine 100 above the conveyor system 200. The gantry 700 comprises at least three servo driven motors 705, 706, 707 that are configured to move the gantry in longitudinal, transverse, and vertical directions, at least two transverse beams 710 coupled to top sections of the at least four vertical supports 110 in the transverse direction, a first track coupled to the at least two transverse beams 710, a gantry beam 715 positioned parallel with respect to the longitudinal feed direction, a second track 730 coupled to the gantry beam 715, and a bag retrieval assembly 720.

Figure 3:
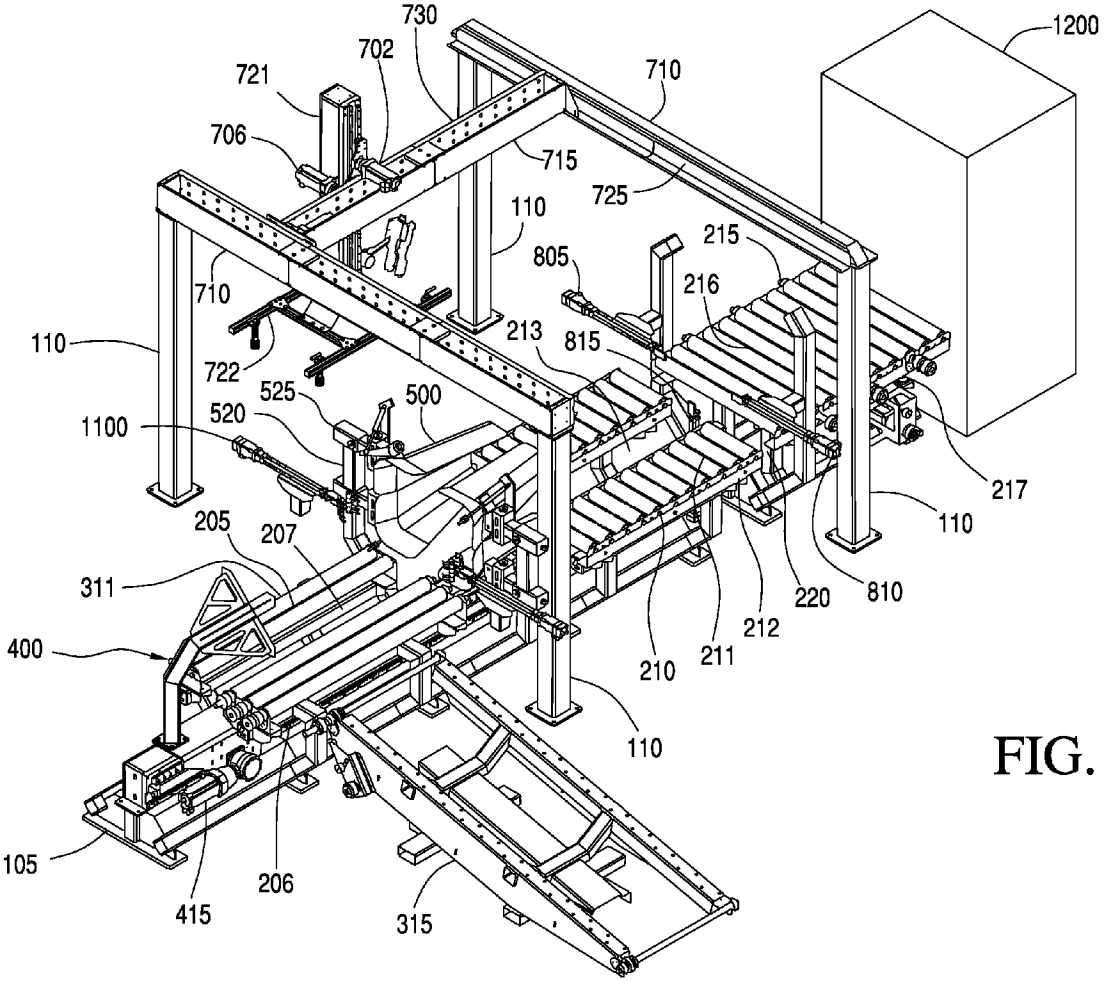
FIG. 3 is a right side isometric view of the bale bagging apparatus showing the sections of the bale bagging apparatus.
Figure 4:
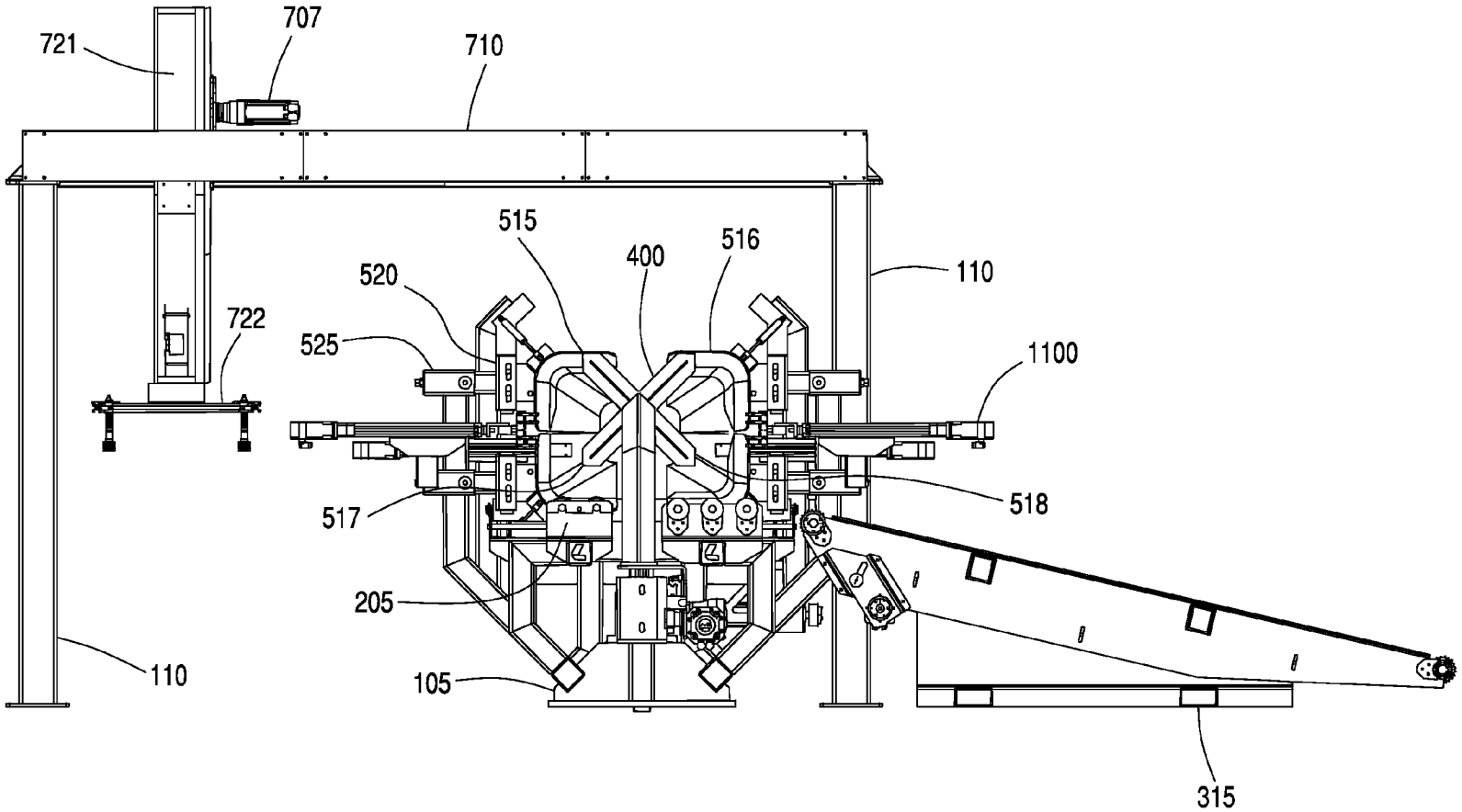
FIG. 4 is a longitudinal front view of the bale bagging apparatus showing the bale feeding station and the bale feeder towards the bale chute.

As seen in FIG. 3, a first servo motor 705 is coupled to the gantry beam 715 to move the gantry beam 715 along the first track 725 in the transverse direction with respect to the longitudinal feed direction, i.e., a Y-direction. Additionally, a second servo motor 706 and the bag retrieval assembly 720 are coupled to the gantry beam 715, so that the second servo motor 706 can control the positioning of the bag retrieval assembly 720 along the second track 730 parallel to the longitudinal feed direction, i.e., a X-direction. The skilled person would appreciate that the first and second tracks 725 comprise belts and motors to allow the movement of the gantry beam 715 and the bag retrieval assembly 720 in their respective directions. Additionally, chains, pulleys, rack and pinion gears, or other devices known in the art can be used with the tracks to allow the movement of the devices.

The bag retrieval assembly 720 comprises the third servo motor 707, a retrieval arm 721, and a bag retaining device 722. The bag retaining device 722 is coupled to one end of the retrieval arm 721 closest to the conveyor system 200. The retrieval arm 721 is coupled to the third servo motor 707 in a way such that the third servo motor 707 is used to control the vertical position, i.e., the Z-direction, of the retrieval arm 721 in directions towards and away from the conveyor system 200. The bag retaining device 722 coupled to one end of the retrieval arm 721 has devices, e.g., suction cups, clamps, gripping fingers, that are configured to grasp the baling bags for displacing the bags, i.e., pick up, from a bag feed position through the bale bagging station 600 to the bale chute 500. The bag retaining device 722 can also have a bag opening device 740 coupled to either the bag retaining device 722 or the suction cups closest to the open end of the bag for maintaining the bags in the open position. For example, the device for maintaining the bags in the open position 740 can use a nozzle to inject air into the open end of the bag to inflate the bag and maintain the bag in the open position.

The skilled person will appreciate that the third servo motor 707 can use various structures to move the retrieval arm 721 in the vertical direction. For example, the retrieval arm 721 can be positioned vertically using a rack and pinion gear structure, pulleys, belts, chains, or other devices that allow the controlled positioning of the retrieval arm.

The sealing module 800 is a sealing module known in the art that can use tape or a heating element (830) to close the open end of the bag around a bagged bale. The sealing module 800, as shown in FIGS. 1-4, includes the third section 215 of the conveyor system 200, a left closing actuator 805, a right closing actuator 810, and a bottom closing actuator 815.

The sealing module 800 is located at the second end of the bale bagging machine 100 after the gap section 220 of the bale bagging station 600. The sealing module 800 in this embodiment is supported by and attached to the second section of the bottom frame member 105 of the bale bagging machine 100.

The left, right, and bottom actuators 805, 810, and 815 are actuators that have a closing tool 825 attached on one end of the actuator. The closing tool 825 is a closing device designed to collapse the open end of the bag over the end of the bale. For example, the closing tool 825 is a plate or finger that pushes open ends of the bag in a given direction.

The left and right closing actuators 805, 810 are coupled to and supported by vertical beams attached at one end to the second section of the bottom frame member 105. The left and right closing actuators 805, 810 have a predetermined length and are coupled to the vertical beams to move transversely with respect to the longitudinal feed direction so that the closing tool 825 of each right and left closing actuator 805, 810 moves in a transverse direction inwardly and outwardly from a center of the sealing module 800. In this embodiment, the center of the sealing module 800 is an imaginary center of a back face of a bale positioned on the sealing module 800 closest to the actuators, so that the actuators can be used to close the open end of the bag around the bale.

The bottom closing actuator 815 is coupled centrally to the bottom frame member at one end so that the closing tool 825 on the other end of the bottom closing actuator 815 can move vertically upwardly towards the center of the sealing module 800 and downwardly away from the center.

The skilled person will appreciate that the closing actuators 805, 810, and 815 are controlled by a sealing module controller (not shown) to control the positioning and timing of the closing actuators. Additionally, a sealing element (830) is used to close the open end of the bag. The sealing element is a tape dispenser, heating element, or other device that can be used to close an open end of the bag. The sealing element can be mounted on any of the actuators to facilitate the closing of the bag.

As seen in FIGS. 1-3, the third section 215 of the conveyor system 200 is coupled to and supported by vertical beams connected to the bottom frame member 105 and comprises longitudinally rotating rollers 216 coupled to a roller frame 217. Similar to the rollers described above, the longitudinally rotating rollers 216 are rotatably coupled to the roller frame 217 to allow the rotation of the longitudinally rotating rollers 216 in the longitudinal direction. The longitudinally rotating rollers 216 can also be driven by a motor (not shown) or allowed to freely rotate.

The simple structure of the bale bagging machine 100 provides a convenient and easy to assemble bale bagging machine that can be easily installed on-site for the bale bagging operation. The stations can be delivered pre-assembled or assembled on site, while the base frame and vertical supports would be delivered for the simple installation at the site.

B. Discussion of Various Methods of Operation of the Bale Bagging Machine

The operation of the bale bagging machine 100 will now be described in detail with reference to FIGS. 9-22.

FIGS. 9-13 shows the picking up of a bag 905 from a pallet of bale bags 900. The skilled person will appreciate that any retrieval device can be used for the movement of the bag, as long as the retrieval device is arranged to position the closed end of the bag in the gap section of the conveyor system. For example, the retrieval device can be mounted on a ceiling above the bale bagging apparatus having a device that can position the retrieval device in the vertical direction and longitudinally along the bale bagging machine.

In this embodiment, the pallet of bale bags 900 as shown is located in a position that is accessible by the bag retrieval assembly 720, i.e., the area in the gantry 700 between the at least four vertical supports 110 of the bale bagging machine 100. The precise position, however, is not limited to the aforementioned position, but may be adjusted as desired within the operational area of the gantry.

Figure 10:
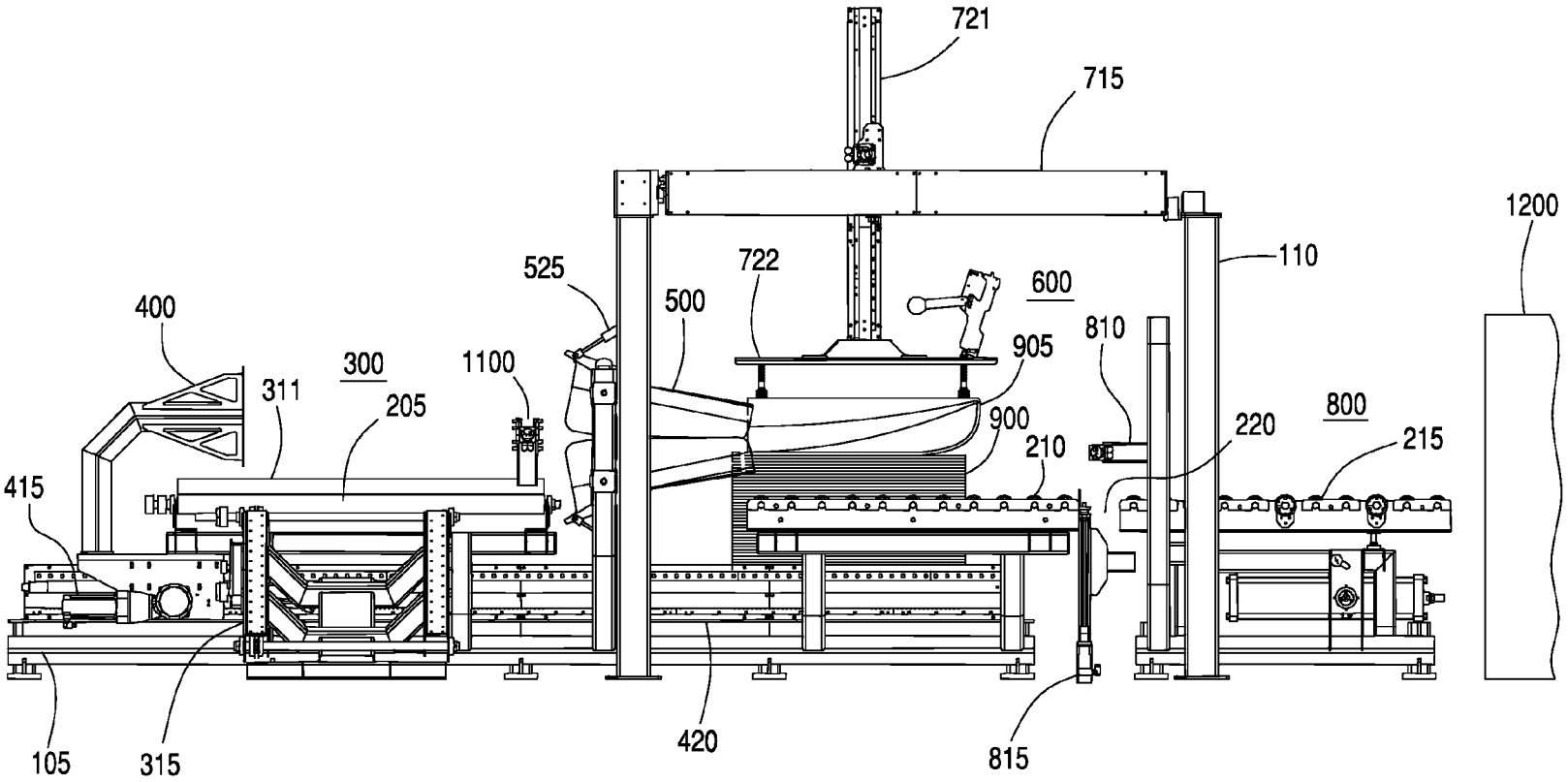
FIG. 10 is a right side view of the bale bagging apparatus according to FIG. 9 showing the picking up of the bag by the retrieval assembly so that the open end of the bag opens and the closed end hangs downwardly.

As seen in FIG. 10, the pallet of bale bags 900 are folded in a way such that an open end 910 is folded on top of a closed end 915 of the bag 1000. When the bag 900 is lifted, i.e., picked up, by the bag retrieval assembly 720, the open end 910 is openable, while the closed end 915 hangs downwardly towards the base of the bale bagging machine 100.

Figure 11:
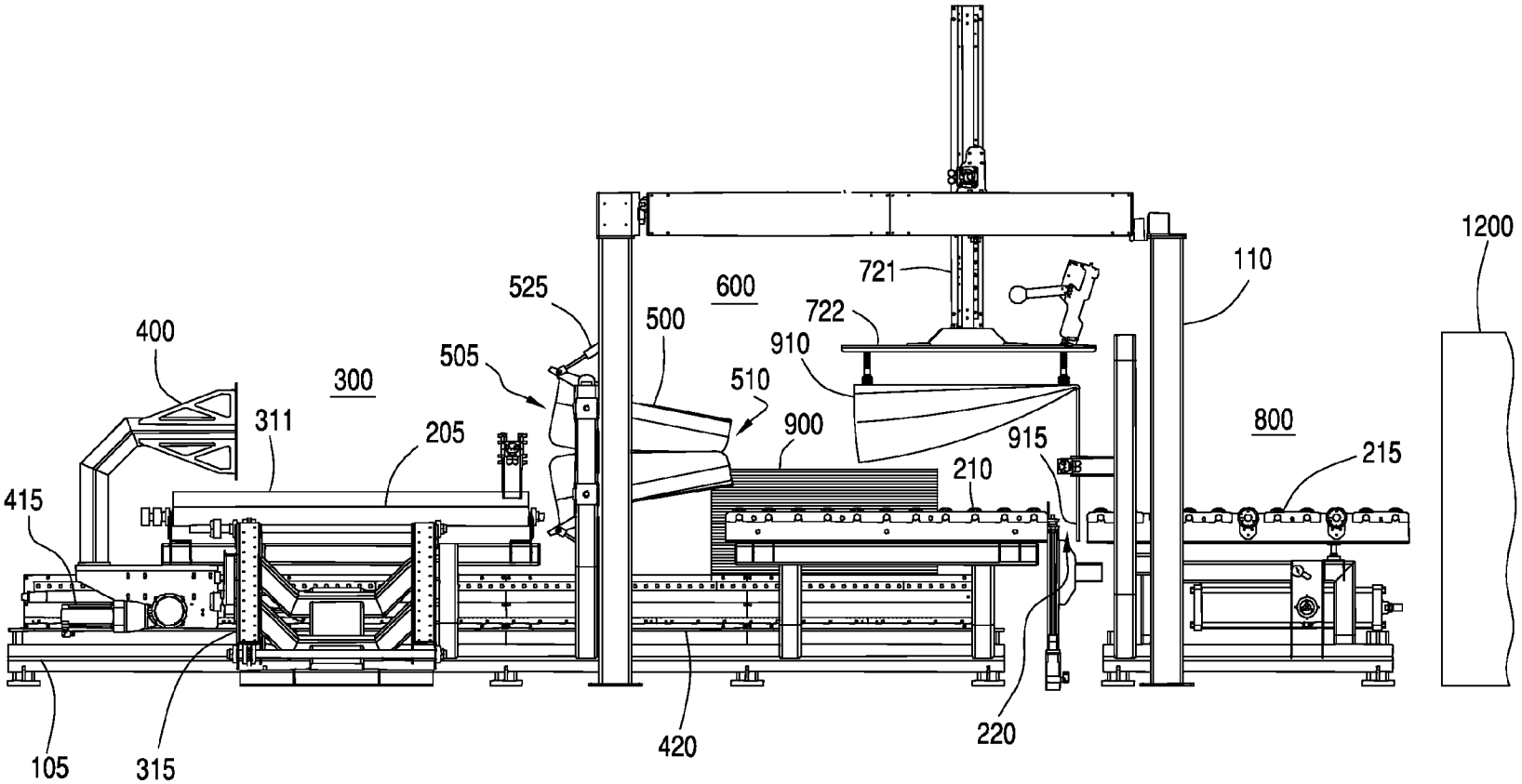
FIG. 11 shows moving the bag retrieval assembly so that the closed end of the bag moves through the at least one gap section of the bagging station.

FIG. 11 illustrates the transference of the bag 905 from the pallet of bags 900 to the bale bagging station 600. After picking up the bag 905, the bag retrieval assembly 720 and bag 905 move in parallel to the longitudinal feed direction rearwardly in this example towards the second end of the bale bagging machine 100 with the closed end 915 of the bag 905 hanging downwardly.

When the bag retrieval assembly 720 is positioned perpendicular to the gap section 220 of the conveyor system 200, the bag retrieval assembly 720 is moved transversely with respect to the longitudinal feed direction, i.e., a lateral direction, so that the closed end 915 of the bag 905 moves laterally through the gap section 220, i.e., perpendicular to the longitudinal feed direction.

Once the closed end 915 of the bag 905 is positioned in the gap section 220, the gantry 700 moves the bag retrieval assembly 720 in the opposite direction, forward in this example towards the first end of the bale bagging machine 100, of the longitudinal feed direction so that the open end 910 of the bag 905 moves towards the bale chute 500.

Figure 12:
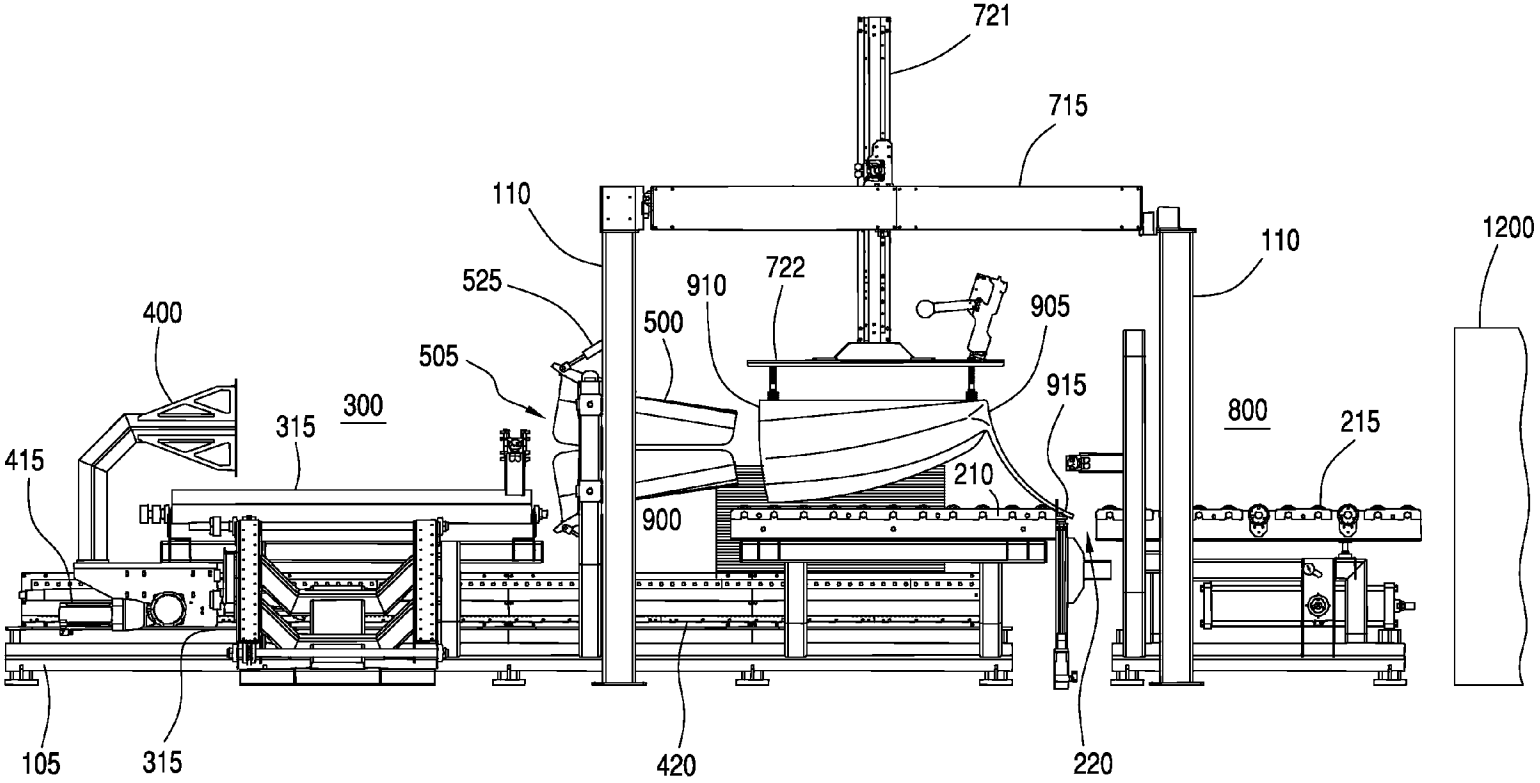
FIG. 12 illustrates moving the open end of the bag towards the bale chute so that the closed end of the bag is straightened.

As seen in FIG. 12, as the open end 910 of the bag 905 moves towards the bale chute 500, the closed end 915 of the bag 905 is positioned on the longitudinally rotating rollers 211 of the second section 210 of the conveyor system 200 in the bale bagging station 600.

Figure 13:
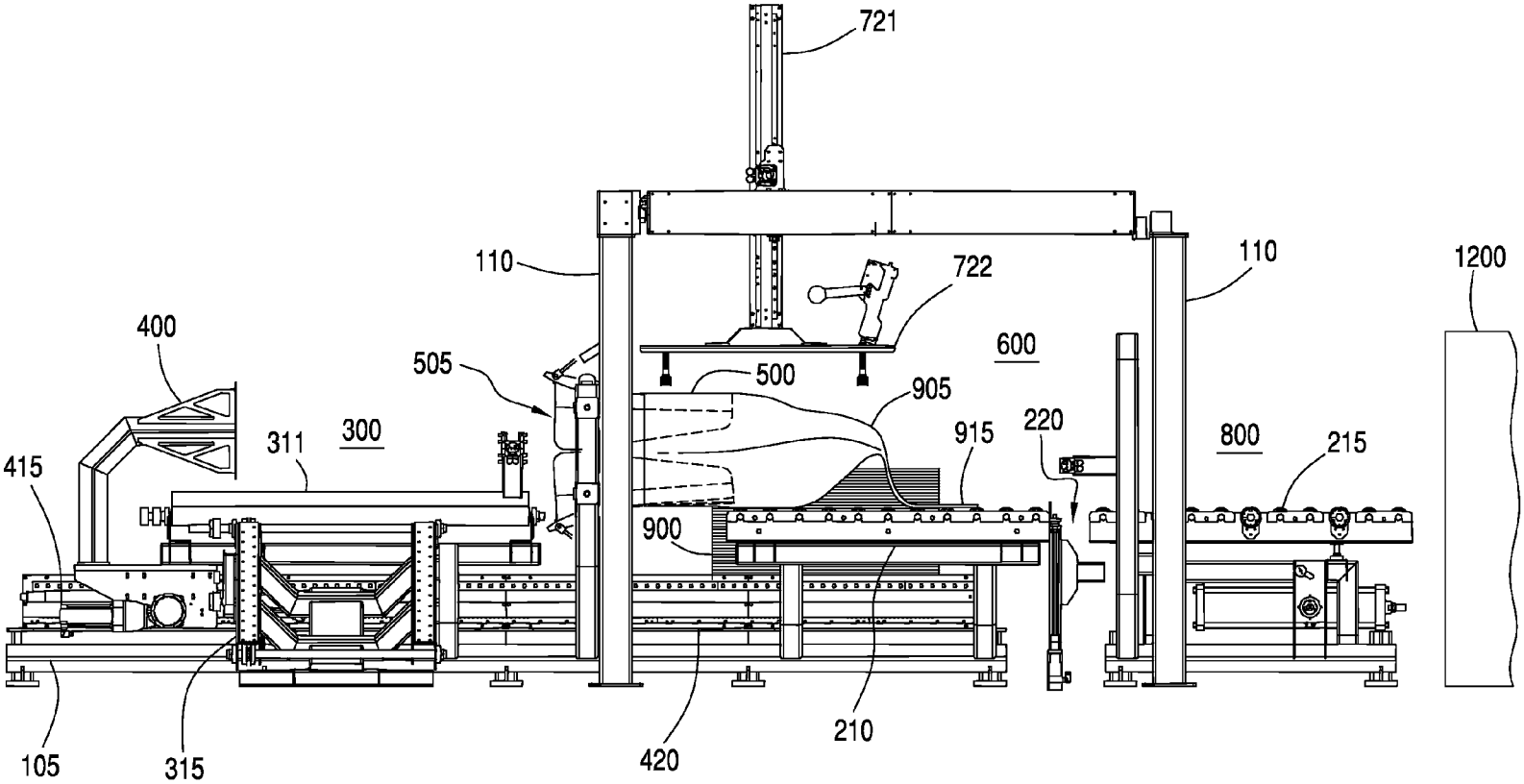
FIG. 13 shows the pivoting sections of the bale chute opening to engage the open end of the bag.

When the open end 910 of the bag 905 is moved towards the bale chute 500 by the gantry 700, the pivoting sections 515, 516, 517, 518 of the bale chute 500 are in the closed position. FIG. 13 shows that after the open end 910 of the bag 905 is positioned around the pivoting sections 515, 516, 517, 518, the pivoting sections are controlled to pivot to the open position, so that the pivoting sections engage an inside surface of the open end 910 of the bag 905 to hold the bag 905 in place, i.e., securely retain the bag.

Surprisingly, it was found that by allowing the closed end 915 of the bag 905 to move through the gap section 220, the positioning of the bag 905 over the pivoting sections of the bale chute 500 and subsequent bagging of the bale was facilitated. This positioning allows the bag to be easily placed in alignment with the longitudinal feed direction to open the bag for receiving the bale, which greatly improves the bale bagging operation.

At another time or the same time as the transferring and positioning of the bag 905 around the pivoting sections of the bale chute 500, a bale 1000, e.g., a cotton bale, is fed onto the bale feeder 315 for feeding the bale 1000 into the bale feeding station 300.

Figure 14:
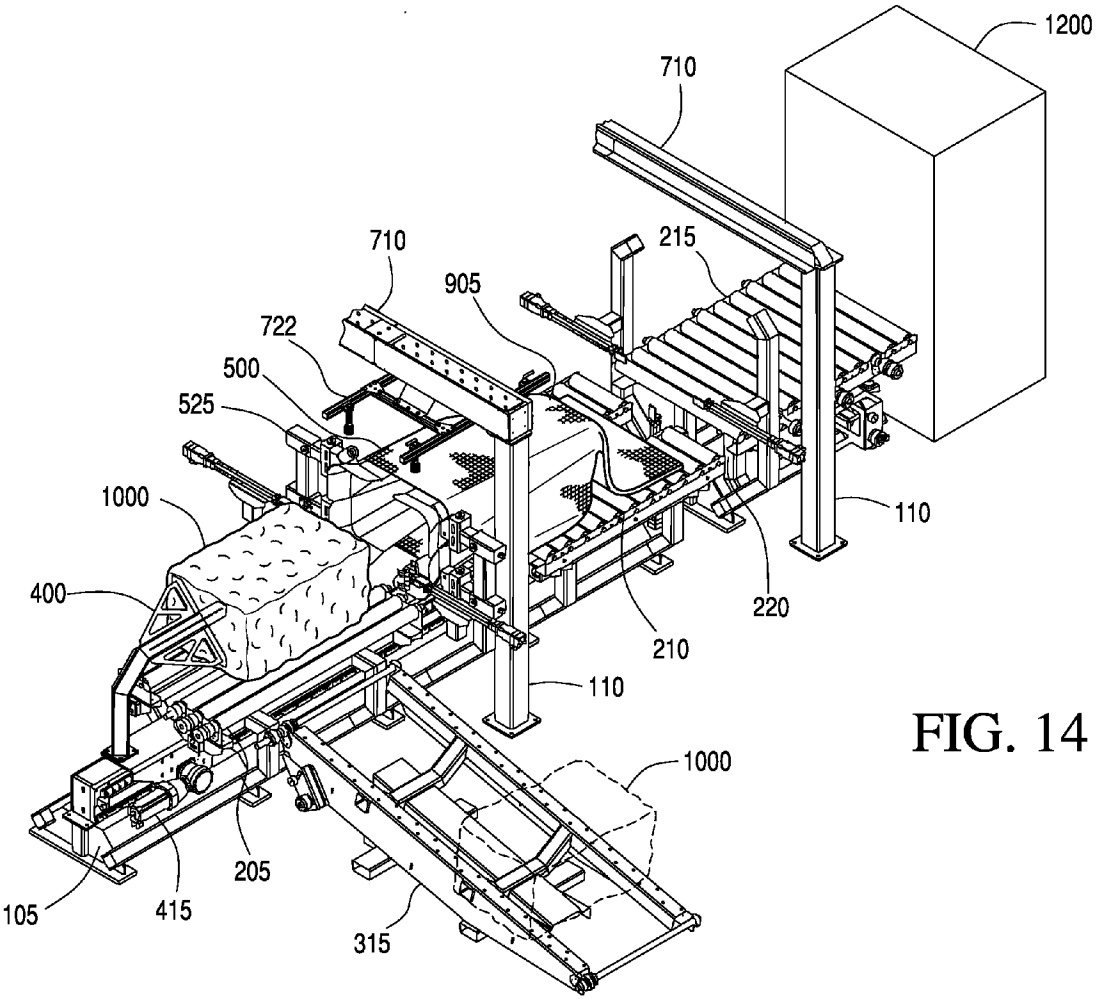
FIG. 14 illustrates the feeding of a bale from the bale feeder to the bale feeding station for feeding the bale to the bale bagging apparatus along the conveyor system.

FIG. 14 illustrates the movement of the bale 1000, where the dotted line represent a first position of the bale 1000 and the solid line represents the second position of the bale 1000 fed by an inclined bale feeder 315 towards the bale feeding section 300. As the bale feeder 315 is feeding the bale 1000 through the bale receiver 305 of the bale feeding station 300, the transverse rotating rollers 206 of the first section 205 can be controlled to rotate transversely with respect to the longitudinal feed direction.

By rotating the transverse rotating rollers 206 transversely with respect to the longitudinal feed direction, the bale 1000 is staged on the first section 205 of the conveyor for the subsequent bagging of the bale 1000 by the bale bagging machine 100. As discussed above, the transverse rotating rollers 206 are used to stage the bale 1000 by using a switch or photoeye that starts and stops the transverse rotating rollers 206 when the desired position of the bale 1000 is detected and/or rotate until the bale 1000 reaches the side bumper 311.

Figure 15:
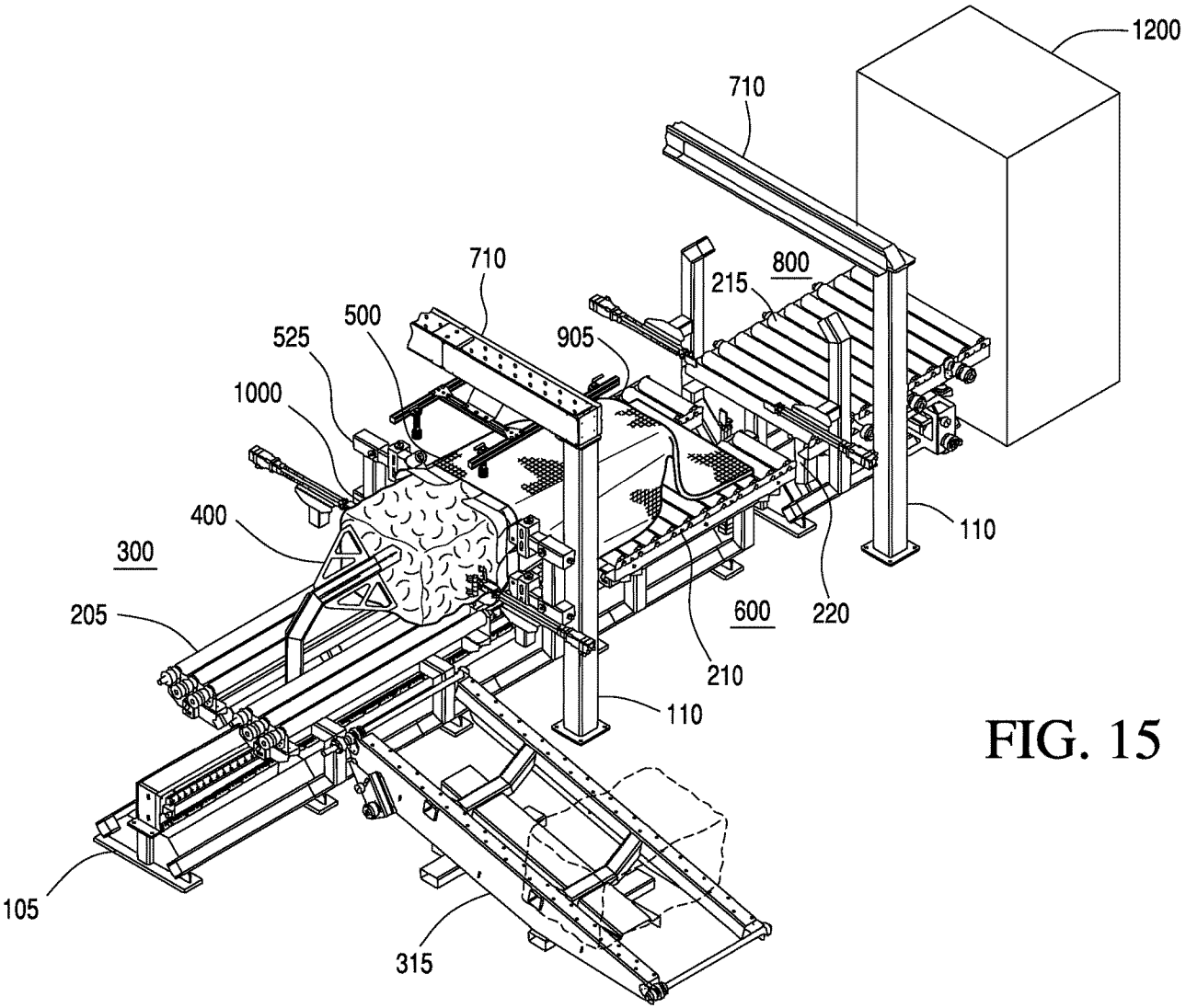
FIG. 15 shows pushing the bale down the bale bagging apparatus from the bale feeding station to the bale chute along the longitudinal feed direction using the bale pusher.

As seen in FIG. 15, after the bale 1000 is staged on the first section 205, the bale pusher 400 pushes the bale 1000 along the longitudinal feed direction towards the input end 505 of the bale chute 500 by controlling the driving mechanism 415 to move along linear drive track 420. As discussed above, the first gap 207 is provided to allow the bale pusher 400 to move along a linearly positioned central line of the bale bagging machine 100 through the first section 205.

The bale pusher 400 pushes the bale 1000 to a first position where one end of the bale 1000 is positioned near the input end of the bale chute 500. The bale pusher 400 then pushes the bale 1000 through the input end 505 of the bale chute 500 with the pivoting sections 515, 516, 517, 518 on the output end 510 in the open position. When the bale chute 500 is in the open position, another gap is provided along the linearly positioned central line between at least the bottom pivoting sections to allow the bale pusher 400 to continue moving in the longitudinal feed direction towards the second end of the bale bagging machine 100.

The bale pusher 400 continues to move in the longitudinal feed direction to push the bale 1000 through the bale chute 500 into the open end 910 of the bag 905 so that the bale 1000 engages the longitudinally rotating rollers 211 of the second section 210. Since the longitudinally rotating rollers 211 are inclined, the bale 1000 only engages the second section 210 at bottom corners of the bale 1000 thereby decreasing any friction and resistance from placing the bale 1000 into the bag 905. It was also found that by inclining the second section 210, the rollers of the second section do not significantly engage baling wire that binds the bale 1000, which prevents roller damage and wear.

Figure 16:
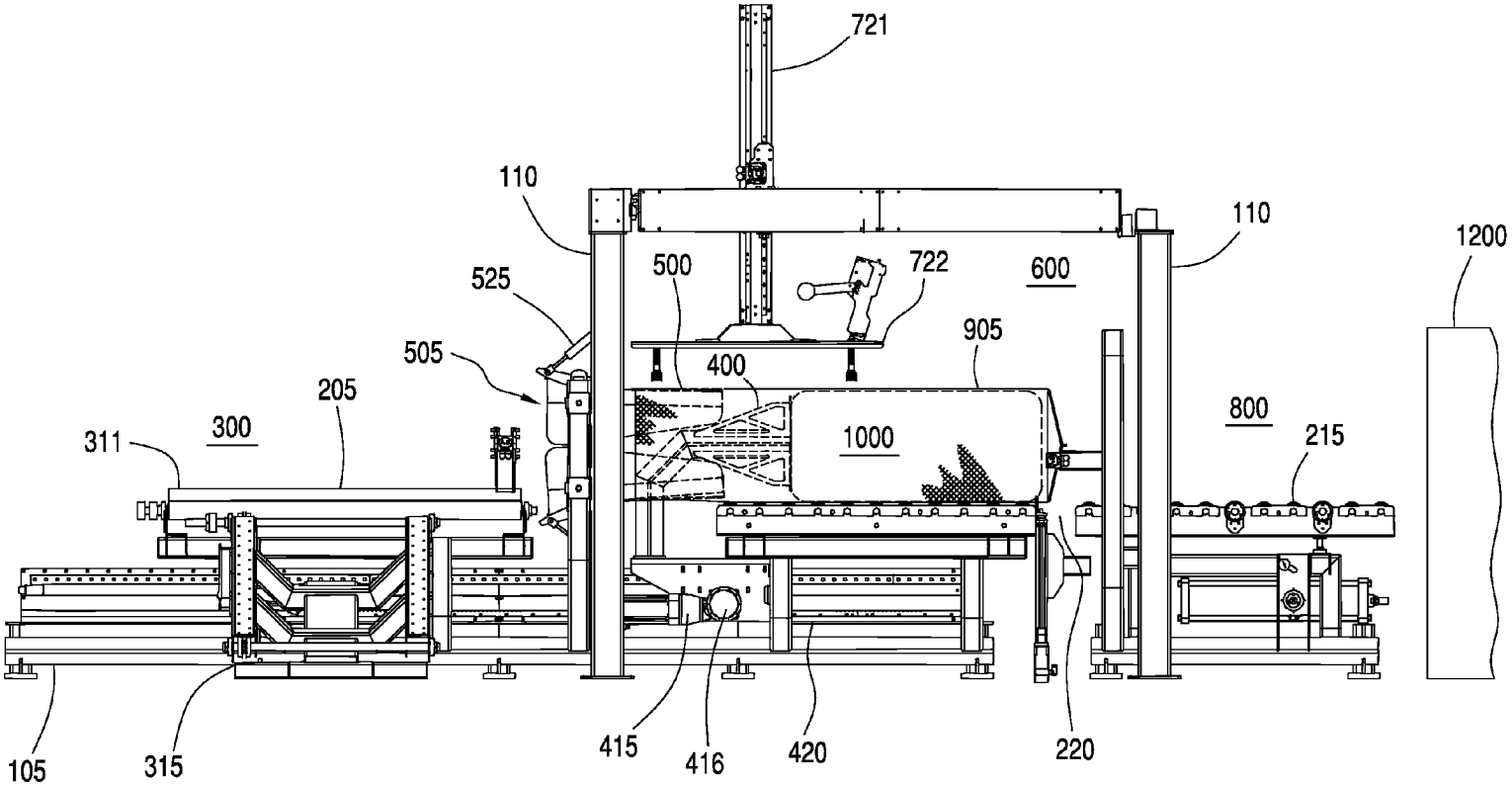
FIG. 16 depicts the bale pusher continuing pushing the bale into the open end of the bag through the bale chute onto the second section of the conveyor system.

FIG. 16 shows the bale pusher 400 pushing the bale 1000 towards the second end of the bale bagging machine 100 so that the bale 1000 engages the closed end 915 of the bag 905. After the bale reaches the closed end 915, the bale pusher 400 continues pushing the bagged bale 1000 onto the second section 210 of the conveyor system 200. When the bale pusher 400 reaches a predetermined position, the pivoting sections 515, 516, 517, 518 are closed or set in the intermediary open position to allow the bag 905 to be released from the bale chute 500.

Figure 17:
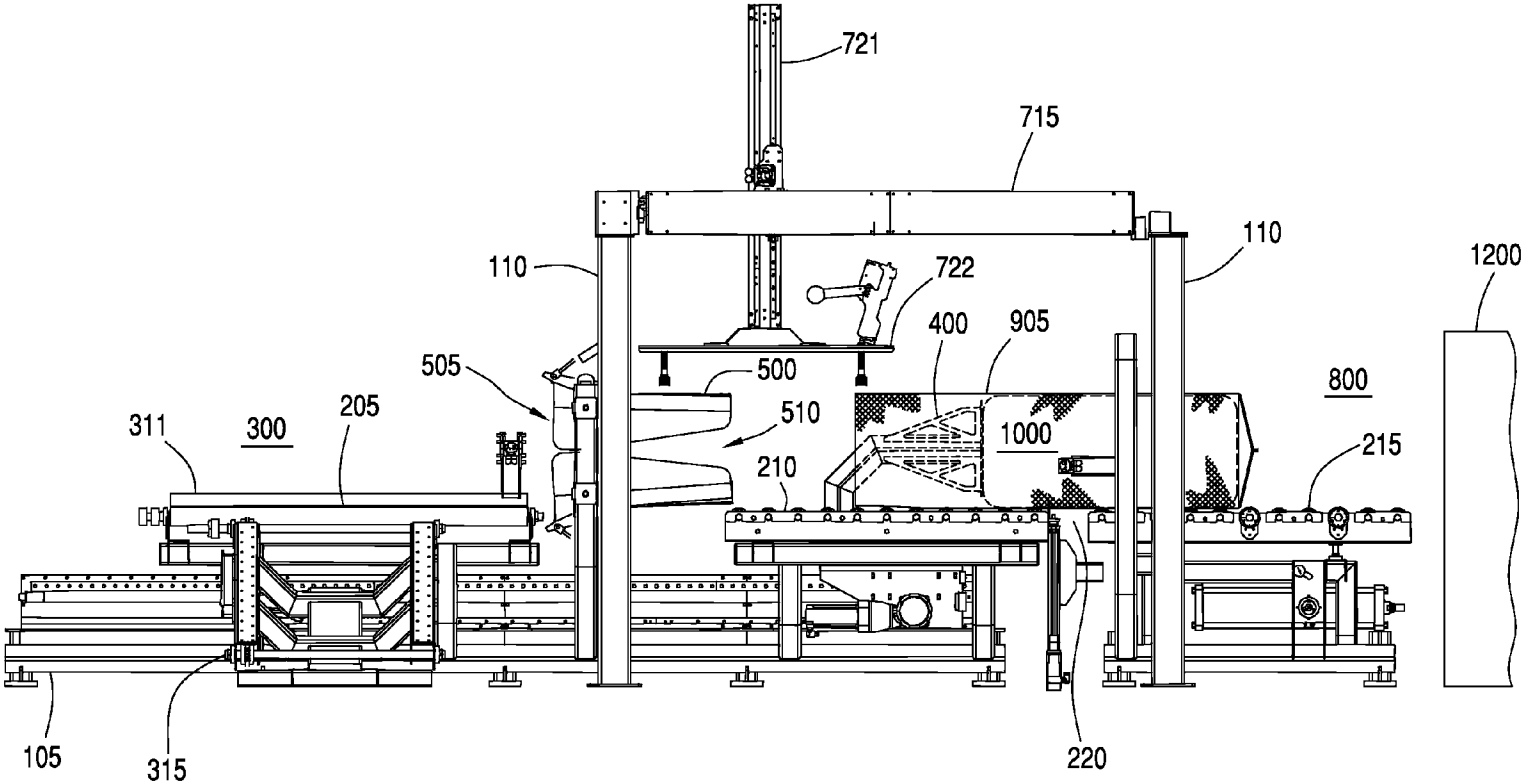
FIG. 17 illustrates the release of the open end of the bag by the pivoting sections of the bale chute as the bale pusher continues pushing the bagged bale down the bale bagging apparatus in the longitudinal feed direction.
Figure 18:
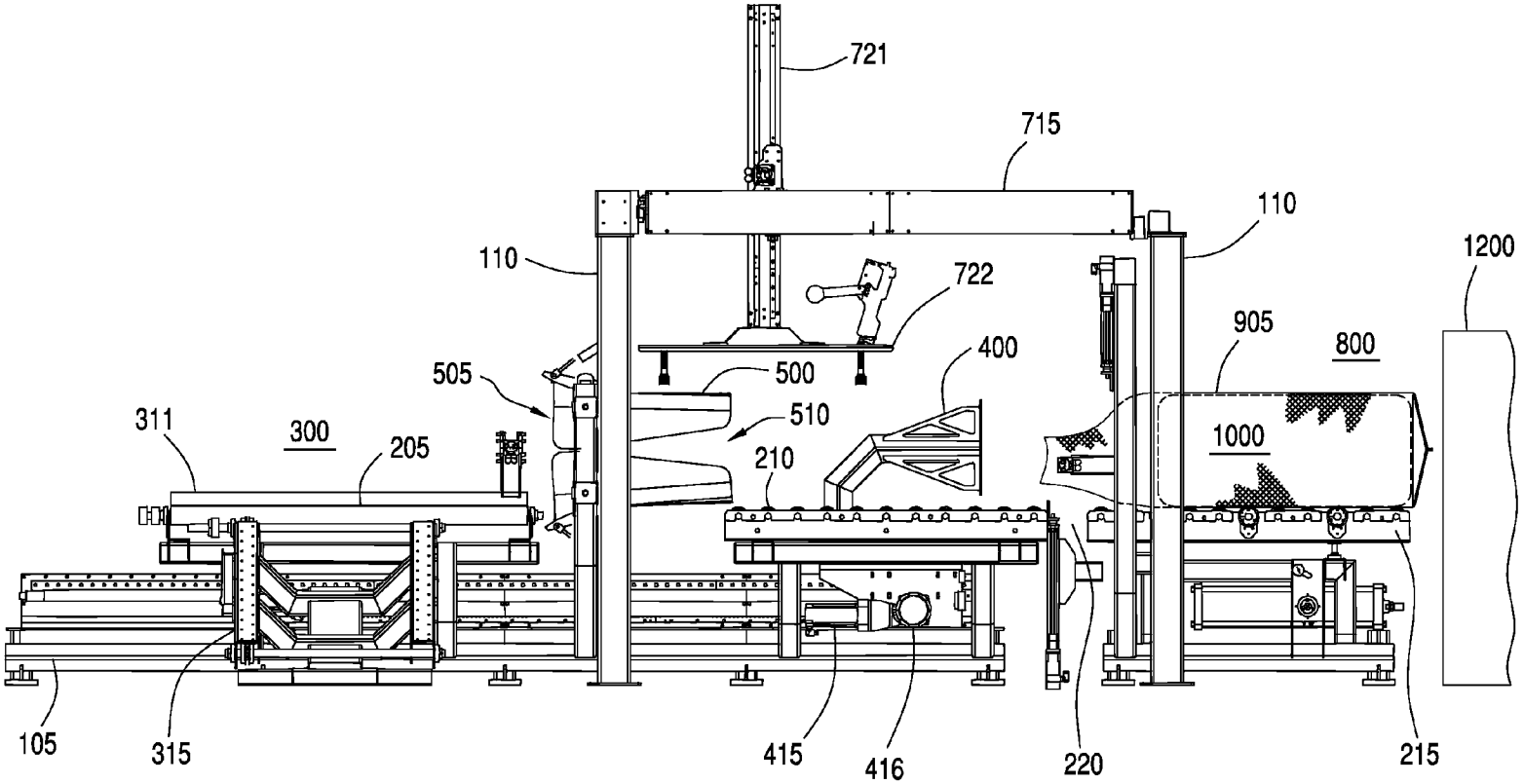
FIG. 18 shows the bale pusher reaching a second position where the bagged bale is placed on a sealing module at the second end of the bottom frame member.
Figure 20:
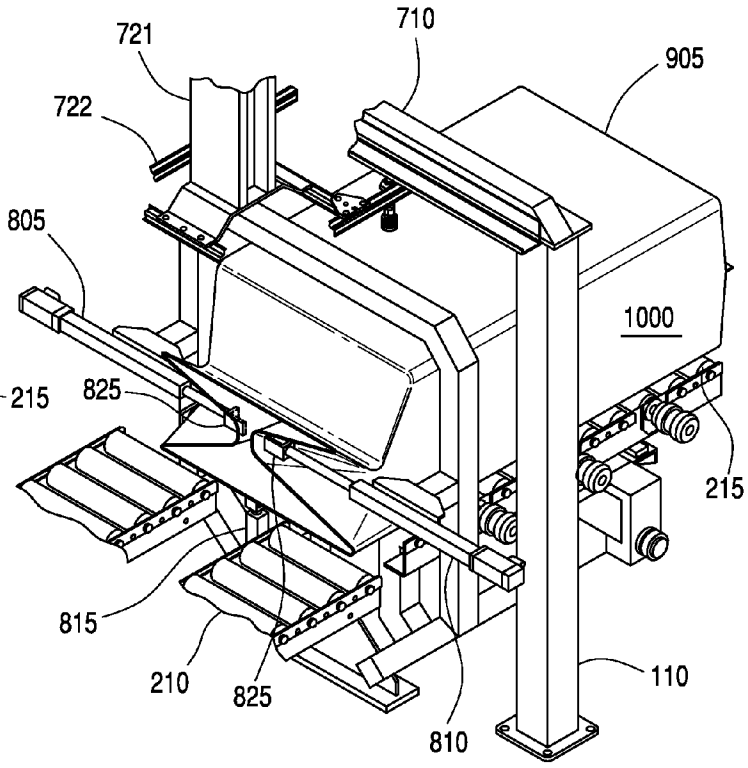
FIG. 20 shows the closing of a top flap of the open end of the bag around the bale after the right and left flaps are closed.

As seen in FIGS. 17-18, the bale pusher 400 continues moving the bale 1000 in the longitudinal feed direction from the second section 210 onto the third section 215 in the sealing module 800 until the bale pusher 400 reaches a predetermined position. After which, the bale pusher 400 returns back to the bale feeding station 300, i.e., reverses direction to move in the opposite direction of the longitudinal feed direction. The skilled person appreciates that the travel of the bale pusher 400 can be controlled using a switch, time, or based on a predetermined length of travel.

FIG. 18 shows the bagged bale 1000 pushed on the third section 215 on the sealing module 800. The longitudinally rotating rollers 215 of the third section 215 facilitate the movement of the bagged bale 1000 onto the third section by rolling the bagged bale 1000 to a predetermined location on the sealing module 800.

Figure 19:
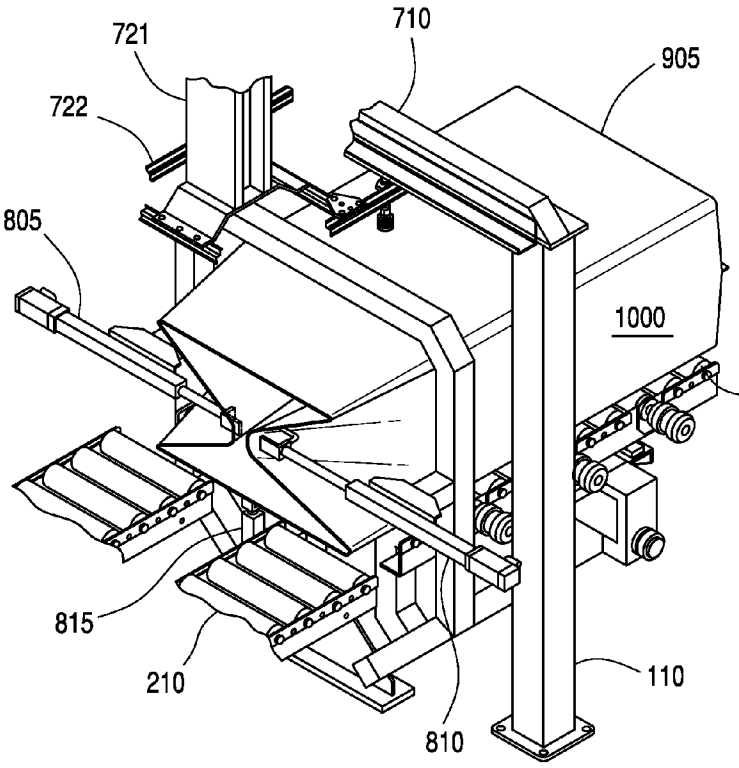
FIG. 19 illustrates the closing of the open end of the bag around the bale at the sealing module by first having right and left closing actuators close the right and left flaps of the open end of the bag.
Figure 22:
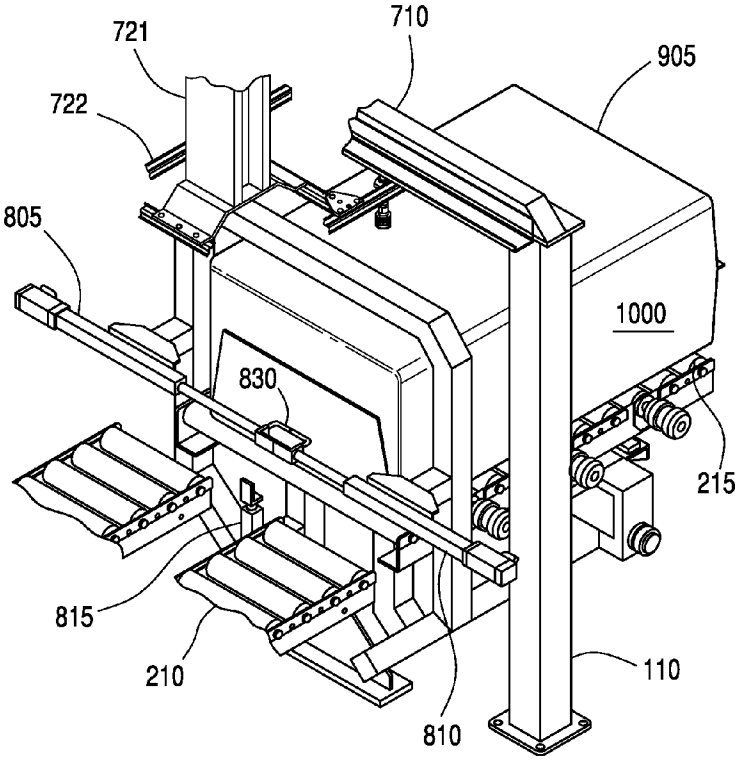
FIG. 22 illustrates a sealing element used at the sealing module for sealing the open end of the bag.
Figure 21:
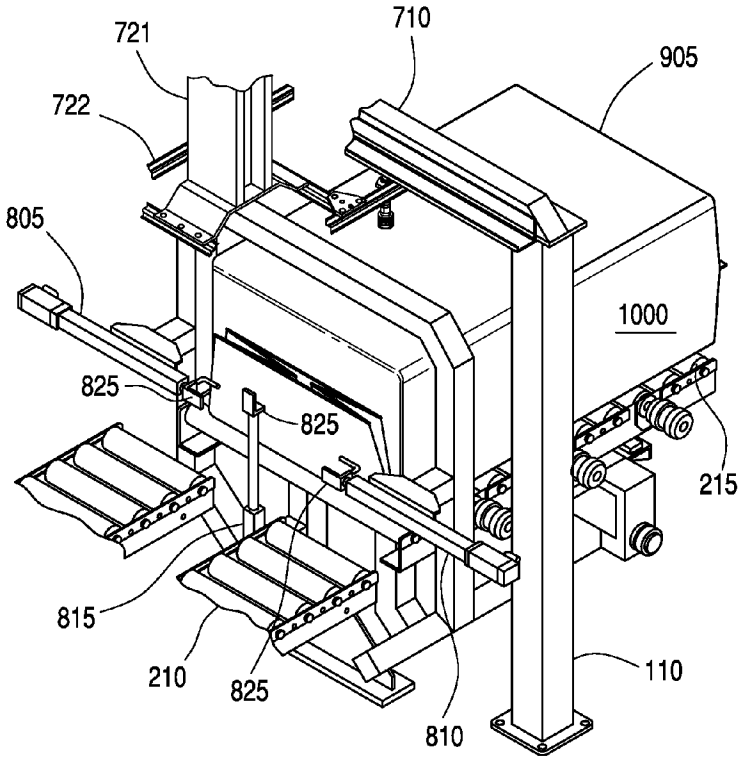
FIG. 21 depicts the closing of a bottom flap of the open end of the bag after the top, right, and left flaps are closed.

FIGS. 19-22 illustrate the sealing of the open end 910 of the bag 905 using the sealing module 800. As illustrated in FIG. 19, once the bagged bale 1000 is positioned on the sealing module 800, the closing tool 825 of the right and left closing actuators 805, 810 begin a sweep from a center to the outside edges engaging the top flap of the open end 910. The right and left closing actuators, then reverse direction and sweep to move to the center of the sealing module 800 which engages right and left flaps, respectively, of the open end 910.

The bottom actuator 815 then moves the closing tool 825 on the bottom actuator 815 upwardly towards the central position of the sealing module 800 to move the bottom flap over the right, left, and top flaps to close the open end 910. Once the bottom flap is nearly closed, the right and left closing actuators 805, 810 are commanded to return the closing tool 825 to their respective start positions.

A sealing element 830, e.g., a heat sealer, tape dispenser, or stapler, is then used to close the bottom flap. The skilled person appreciates that the sealing of the open end 910 of the bag 905 can be sealed in a variety of ways and is not limited to the foregoing description.

Figure 23:
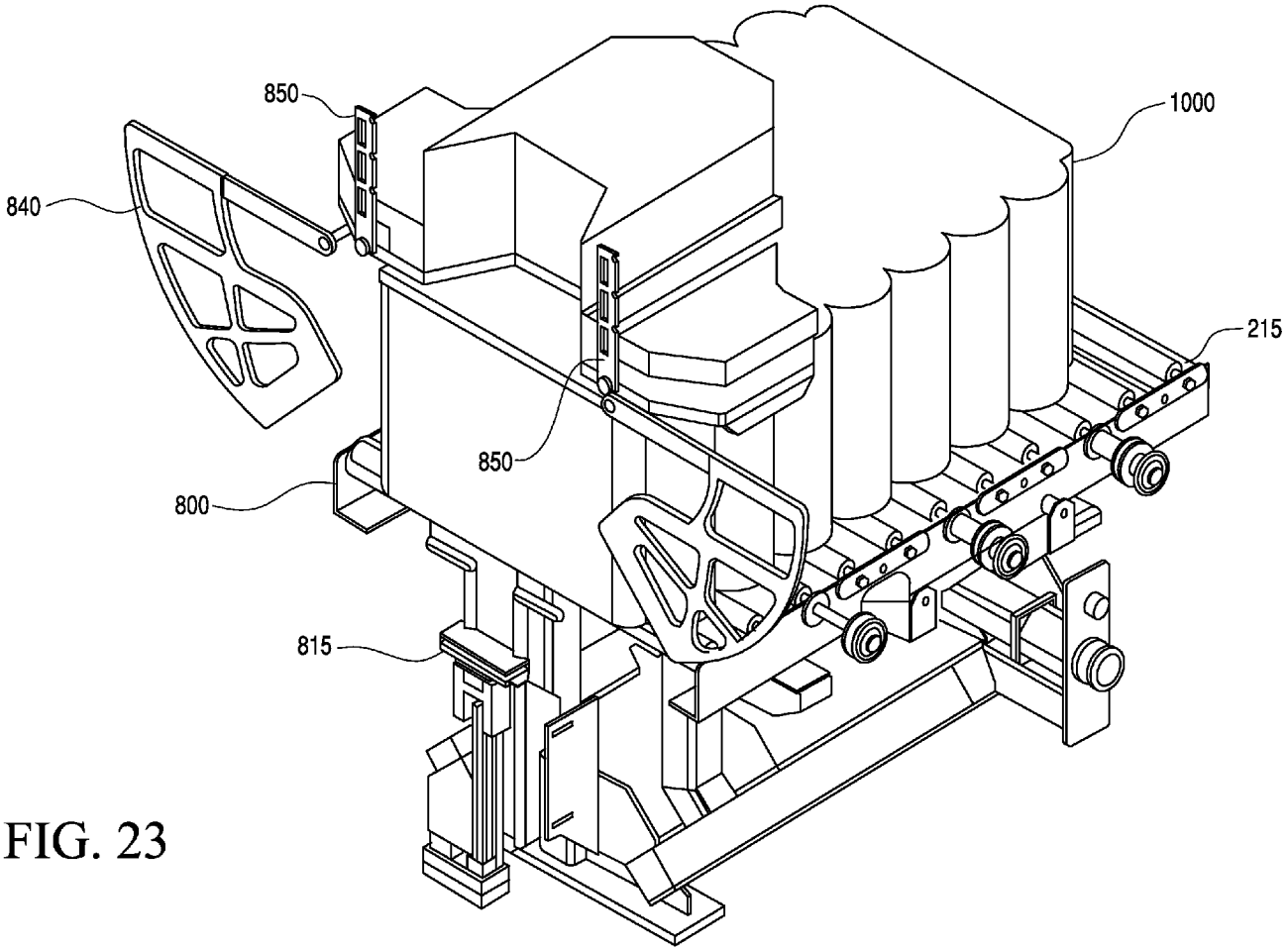
FIG. 23 illustrates an alternative sealing element used to close and seal the open end of the bag.

For example, as seen in FIG. 23, sealing module 800 is attached to the frame member of the bale bagging machine 100 (not shown for clarity) and comprises transversely rotating side closure mechanisms 840 and rotating top closure mechanisms 850. In a similar manner as discussed above with respect to the closure actuators 805, 810 of the sealing module 800, the transversely rotating side closure mechanisms 840 are pivotably rotated to move in a transverse direction with respect to the longitudinal feed direction of the bale bagging machine 100 to engage the right and left flaps of the open end 910 of the bag 905 and move the right and left flaps towards the central position of the sealing module 800.

In this embodiment, top closure mechanisms 850 are then configured to engage the top flap of the open end 910 of the bag 905 by pivotally rotating downwardly towards the central position of the sealing module 800 to move the top flap towards the center of the sealing module 800. The bottom actuator 815 is then configured to move upwardly towards the central position of the sealing module 800 to move the bottom flap over the right and left flaps. A sealing member, similar to the devices discussed above, can then be used to close the flaps.

The invention is not to be limited by the description of exemplary embodiments of the invention, but only by the scope of the appended claims.

For example, as seen in FIG. 1, a sampling station 1100 can be installed on the bale bagging machine 100. The sample station 1100 is coupled to vertical supports having one end coupled to the bottom frame member 105. The sample station 1100 comprises automated grippers 1105 mounted on ends of an automated linear actuator 1110 with position indication devices.

The automated grippers 1105 are positioned to move transversely to the longitudinal feed direction to allow the taking of a sample of the bale 1000 from sides of the bale 1000. Once the bale 1000 is positioned at the first position, the automated grippers are controlled by a controller (not shown) to take the required samples.

The automated grippers 1105 can use fingers that open and close to grab the sample or can use other devices that allow the taking of samples from the bale. Once the sample is taken, the automated grippers 1105 are controlled to return to a position away from the bale 1000.

An automatic label applicator can also be installed on the bale bagging machine 100 after the sealing module 800. The automatic label applicator can be installed as a separate station or coupled to the bottom frame member 105. The automatic label applicator is designed to place a preprinted label on the side of the bagged bale.

As the bale pusher 400 moves the bagged bale 1000 towards the sealing module 300, a switch is used to control the positioning of the automatic label applicator to engage the side of the bagged bale 1000 by moving transversely towards the bagged bale 1000.

Additionally, the sealing module 800 can further comprise an automatic weighing station having load cells incorporated into the third section 215. The automatic weighing station is designed to obtain a legal for trade weight of every bagged bale 1000. Specifically, driven rollers 216 are supported on the load cells (not shown) to weigh the bales. The driven rollers 216 are controlled using a controller (not shown) to optimize the interface of the bagged bale with the bag closing and sealing mechanisms, to ensure that the bagged bale is positioned correctly for weighing purposes, labeling, and data collection or tagging verification purposes, and provide the control of the necessary sped an dacelaration of the driven rollers to promote the proper orientation of the bale.

A bale discharge roller conveyor 1200 can also be installed after the sealing module 800 or in place of the sealing module 800. The bale discharge roller conveyor 1200 can be coupled to the bottom frame member 105 or separately attached to the sealing module 800.

The bale discharge roller conveyor 1200 has a base designed to support bag closing, label application, bale weighing, and bale discharge from the machine. The bale discharge roller conveyor 1200 also has static rollers and driven rollers to facilitate the discharge of the bagged bale 1000. An outfeed section of the bale discharge roller conveyor 1200 has a set of gravity rollers that are isolated from the portion of the conveyor that is mounted to the load cells. These isolated rollers prevent excessive lateral forces from being exerted on the section of the conveyor mounted to the load cells. The bale discharge roller conveyor is also equipped with a linear actuator for indexing of multiple discharged bales.

The bale discharge roller conveyor 1200 is engaged when the bale pusher 400 advances to a predetermined position, so that the bagged bale 1000 engages the driven rollers for the advancement of the bagged bale 1000. After the bag has been closed and sealed, the bagged bale 1000 is weighed. Once the bale has been weighed, the bale discharge roller conveyor 1200 will begin discharging the bale 1000 by allowing the bale to reach the last roller and then fall on the floor.

Figure 24:
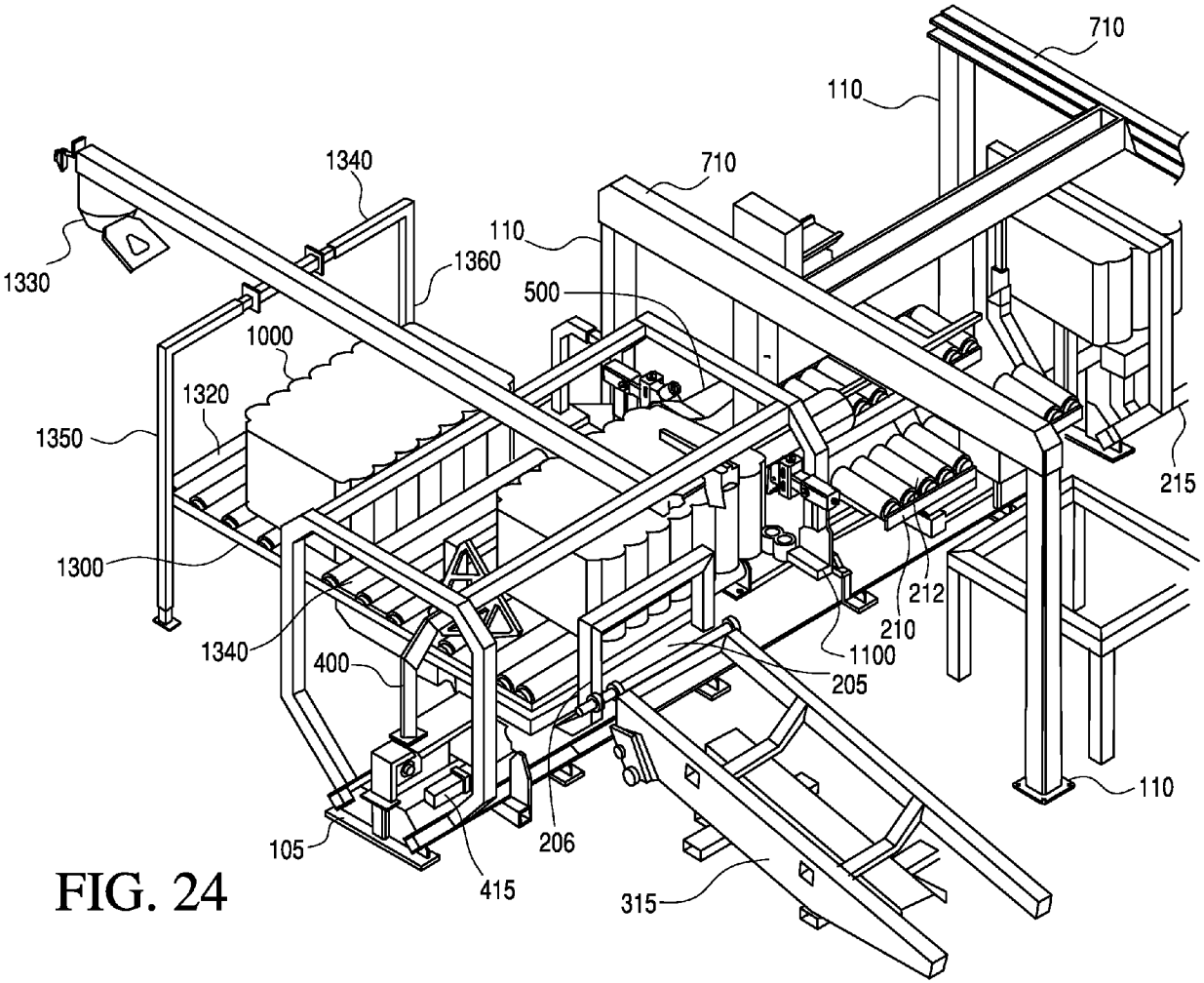
FIG. 24 illustrates an alternative feeding device at the bale feeding station.

As seen in FIG. 24, it is also contemplated that the embodiments of the bale bagging machine discussed above can further include a bale transferring system 1300 located at or near the bale feeding station 300. The bale transferring system 1300 includes a bale transferring conveyor system 1310 having static rollers 1320, an overhead transfer device 1330, and a support frame 1340. The support frame 1340 can be supported by vertical frame members 1350 and/or coupled to the bale bagging apparatus 100. A transverse gantry beam 1360 is provided on the support frame 1340 so that the overhead transfer device 1330 can move transversely with respect to the longitudinal feed direction of the bale bagging apparatus.

In this embodiment, the bale bagging station 300 does not include side bumper 311, instead, one end of the bale transferring system 1300 is coupled to the bale feeding station 300 to feed a bale from an opposite side of the bale feeding station 300 from the bale feeder 315. The other end of the bale transferring system 1300 is coupled to an adjacent bale processing equipment that is used to prepare the bales for subsequent bagging, for example, a bale pressing process. After completion of the pressing process, the bale 1000 is positioned on the static rollers 1320 of the transferring conveyor system 1310 so that the overhead transfer device 1330 is engageable with the bale 1000 to move and position the bale 100 transversely into the bale feeding station 300 to begin the bagging process.

Moreover, safeguards can be installed on the bale bagging machine 100 for safety of the equipment and operators. For example, a safety switch (not shown) can be installed on the conveyor system 200 that detects any obstruction to stop the bale pusher 800 from advancing in the direction of the longitudinal feed direction.

Additionally, while the methods of operation have been discussed above in detail, the sequence of the steps is not limited to the above described method. In fact, the sequence of the steps can be performed in any order as needed for the bale bagging operation.

The invention claimed is:

1. A bale bagging apparatus having a first end and a second end for wrapping a bag around a bale, said apparatus comprising:

a base frame member having a first end and a second end;

a transportation system configured to transport a bale from the first end of the bale bagging machine to the second end of the bale bagging machine, wherein said transportation system has a first gap section and a second gap section;

a bale chute having an input end close to the first end of the bale bagging machine and an output end downstream of the input end closer to the second end of the bale bagging machine, wherein said bale chute comprises at least two pivotable sections configured to pivot between at least a closed position and an open position; and a bag retrieval system configured to position a bag from a first position to a second position to a third position, wherein said second position is arranged so that a closed end of a bag is positioned in the first gap section of the transportation system and wherein said third position is arranged so that an open end of the bag is positioned around the output end of the bale chute, wherein the second gap section is arranged to extend along a direction parallel to a longitudinal feed direction, the longitudinal feed direction extending from the first end to the second end, the second gap section being defined by a first longitudinal support member and a second longitudinal support member, the second gap section being between the first longitudinal support member and the second longitudinal support member, the first longitudinal support member and the second longitudinal support member being configured to contact and vertically support the bale;

wherein the first longitudinal support member and the second longitudinal support member are each inclined, in a direction substantially perpendicular to the longitudinal feed direction, with an inner portion of each of the first longitudinal support member and the second longitudinal support member being lower than an outer portion of each of the first longitudinal support member and the second longitudinal support member.

2. A bale bagging apparatus having a longitudinal feed direction for wrapping a bag having an open end and a closed end around a bale, said apparatus comprising:

a base frame member having a first end and a second end that is parallel to the longitudinal feed direction;

a conveyor system comprising a first section, a second section, a third section, and a first gap section and a second gap section, said first section coupled to the first end of the base frame member and said third section coupled to said second end of the base frame member to transport said bale in the longitudinal feed direction from the first section to the third section, wherein said first gap section is positioned between the second and third section of the conveyor system, and the second gap section is arranged to extend along a direction parallel to the longitudinal feed direction, the second gap section being defined by a first longitudinal support member and a second longitudinal support member, the second gap section being between the first longitudinal support member and the second longitudinal support member, the first longitudinal support member and the second longitudinal support member being configured to contact and vertically support the bale;

a bale feeding station having an bale receiver, a staging device, and the first section of the conveyor system, said bale feeding station coupled to the first end of the base frame member, wherein said bale receiver is arranged to receive the bale and said staging device is arranged to position and align the bale on the first section of the conveyor system;

a bale chute having an input end near the bale feeding station and an output end downstream of said input end along the longitudinal feed direction, said bale chute coupled to the base frame member between the first and second ends, wherein said output end has at least two pivotable sections attached to said base frame member in a way such that the at least two pivotable sections pivot between at least a closed position and an open position;

a bagging station downstream of the bale chute along the longitudinal feed direction between the first and second ends of the base frame member comprising a gantry and the second section and a first gap section of the conveyor system, said second section coupled to the base frame member;

the gantry comprising at least two vertical supports having top sections, a gantry beam having a first and second end coupled to each of said top sections of the at least two vertical supports parallel to the longitudinal feed direction, a track coupled to the gantry beam, and a retrieval assembly movably coupled to the gantry beam to move along the track, said retrieval assembly comprising a vertical lifting device, said at least two vertical supports positioned transversely to the base frame member between the first and second ends of the base frame member so that said retrieval assembly is positionable along the longitudinal feed direction between the bale chute and said second gap section;

a bale pusher having a pushing section coupled to a driving mechanism, said driving mechanism coupled to the base frame member and configured to move the bale pusher in the longitudinal feed direction in a forward direction towards the second end of the base frame member and a reverse direction towards the first end of the base frame member; and a sealing module located after the bagging station and coupled to the second end of the base frame member, said sealing module comprising the third section of the conveyor system and a sealing element, wherein said first section of the conveyor system comprises a frame member and transversely rotating rollers rotatable coupled to said frame member and configured to rotate in a direction transverse to the longitudinal feed direction.

3. The bale bagging apparatus of claim 2, further comprising a bale feeder coupled to the bale feeding station and configured to feed a bale onto the first section of the conveyor system from a direction transverse to the longitudinal feed direction, wherein said bale receiver is positioned to receive the bale from the transverse direction.

4. The bale bagging apparatus of claim 3, wherein the bale feeder comprises an inclined drag chain conveyor.

5. The bale bagging apparatus of claim 2, the transversely rotating rollers are configured to be driven to rotate, and said bale bagging apparatus further comprises a switch, photoeye, or light curtain, wherein said switch, photoeye, or light curtain is configured to detect the presence of a bale.

6. The bale bagging apparatus of claim 2, wherein said bale receiver is positioned to receive a bale from a transverse direction with respect to the longitudinal feed direction and said staging device comprises a side bumper positioned on an opposite side of the bale receiver across the first section of the conveyor system, said side bumper coupled to said bale frame member parallel to the longitudinal feed direction.

7. The bale bagging apparatus of claim 2, wherein the bale chute comprises at least four pivoting sections pivotably coupled to the base frame member, wherein said at least four pivoting sections are arranged to pivot between at least an open and closed position.

8. The bale bagging apparatus of claim 7, wherein the at least four pivoting sections are arranged to also pivot to an intermediary open position.

9. The bale bagging apparatus of claim 2, wherein said second section of the conveyor system comprises at least two frame members coupled to and supported by the base frame member and at least two sets of rollers rotatably coupled to the at least two frame members, said at least two sets of rollers arranged to roll in the longitudinal feed direction.

10. The bale bagging apparatus of claim 9, wherein the at least two sets of rollers have one end of the rollers located on an outer side of the frame members positioned above another end of the rollers located near a center of the second section.

11. The bale bagging apparatus of claim 2, further comprising a bale sampling station coupled to the base frame member after the bale feeding section, said bale sampling station having an automated gripper arranged to move in a transverse direction with respect to the longitudinal feed direction to remove a sample from a bale located on the conveyor system.

12. The bale bagging apparatus of claim 2, wherein the retrieval assembly comprises an end-of-arm-tool on one end of the retrieval assembly, said end-of-arm-tool having at least two suction cups for engaging and positioning a bag.

13. A bale bagging apparatus having a longitudinal feed direction for wrapping a bag having an open end and a closed end around a bale, said apparatus comprising:

a base frame member having a first end and a second end that is parallel to the longitudinal feed direction;

a conveyor system comprising a first section, a second section, a third section, and a first gap section and a second gap section, said first section coupled to the first end of the base frame member and said third section coupled to said second end of the base frame member to transport said bale in the longitudinal feed direction from the first section to the third section, wherein said first gap section is positioned between the second and third section of the conveyor system, and said second gap section is arranged to extend along a direction parallel to the longitudinal feed direction, the second gap section being defined by a first longitudinal support member and a second longitudinal support member, the second gap section being between the first longitudinal support member and the second longitudinal support member, the first longitudinal support member and the second longitudinal support member being configured to contact and vertically support the bale;

a bale feeding station having an bale receiver, a staging device, and the first section of the conveyor system, said bale feeding station coupled to the first end of the base frame member, wherein said bale receiver is arranged to receive the bale and said staging device is arranged to position and align the bale on the first section of the conveyor system;

a bale chute having an input end near the bale feeding station and an output end downstream of said input end along the longitudinal feed direction, said bale chute coupled to the base frame member between the first and second ends, wherein said output end has at least two pivotable sections attached to said base frame member in a way such that the at least two pivotable sections pivot between at least a closed position and an open position;

a bagging station downstream of the bale chute along the longitudinal feed direction between the first and second ends of the base frame member comprising a gantry and the second section and the first gap section of the conveyor system, said second section coupled to the base frame member;

the gantry comprising at least two pairs of two vertical supports each having top sections, at least two transverse beams coupled to the top sections of each pair of vertical supports connecting said supports in a direction transverse to the longitudinal feed direction, a first track coupled to each of the at least two transverse beams, a gantry beam having a first and second end coupled to the first track so that the gantry beam is parallel to the longitudinal feed direction, a second track coupled to the gantry beam, and a retrieval assembly movably coupled to the gantry beam to move along the second track, said retrieval assembly comprising a vertical lifting device, said at least two pairs of two vertical supports positioned transversely to the base frame member between the first and second ends of the base frame member so that said retrieval assembly is positionable along the longitudinal feed direction and lateral direction transverse to the longitudinal feed direction between the bale chute and the second gap section;

a bale pusher having a pushing section coupled to a driving mechanism, said driving mechanism coupled to the base frame member and configured to move the bale pusher in the longitudinal feed direction in a forward direction towards the second end of the base frame member and a reverse direction towards the first end of the base frame member; and a sealing module located after the bagging station and coupled to the second end of the base frame member, said sealing module comprising the third section of the conveyor system and a sealing element, wherein said first section of the conveyor system comprises a frame member and transversely rotating rollers rotatably coupled to said frame member and configured to rotate in a direction transverse to the longitudinal feed direction.

14. A method for wrapping a bag around a bale using the bale bagging apparatus of claim 2, comprising the steps:

lifting a bag from a bag feed position between the vertical supports of the gantry by an open end of the bag so that said open end is openable and a closed end of the bag hangs downwardly;

moving the bag towards the second end of the bale bagging apparatus in a direction parallel to the longitudinal feed direction until the closed end of the bag is aligned perpendicularly with the at least one gap;

moving the bag laterally towards the at least one gap section until the closed end of the bag is positioned in the at least one gap;

moving the bag towards the bale chute in an opposite direction of the longitudinal feed direction until the open end of the bag is positioned around the at least two pivoting sections of the bale chute;

opening said at least two pivoting sections of the bale chute so that the pivoting sections engage an inside surface of the open end of the bag to secure the bag;

transporting a bale from the bale feeding station towards the input end of the bale chute on the conveyor system in the longitudinal feed direction; and pushing said bale though the bale chute into the open end of the bag.

15. The bale bagging apparatus of claim 1, wherein each of the first longitudinal support member and the second longitudinal support member are inclined at an angle greater than 5° from an imaginary horizontal plane.

16. The bale bagging apparatus of claim 1, wherein the second gap section has a width to allow a movement of a bale pusher between the first longitudinal support member and the second longitudinal support member.

17. The bale bagging apparatus of claim 1, wherein each of the first longitudinal support member and the second longitudinal support member are substantially horizontal with respect to the base frame member of the bale bagging apparatus.

18. The bale bagging apparatus of claim 1, wherein a set of longitudinally rotating rollers is provided on each of the first longitudinal support member and the second longitudinal support member.

* * * * *